US009469121B2

(12) United States Patent
Sawada

(10) Patent No.: US 9,469,121 B2
(45) Date of Patent: Oct. 18, 2016

(54) INKJET PRINTER

(71) Applicant: Roland DG Corporation, Hamamatsu-shi, Shizuoka (JP)

(72) Inventor: Teppei Sawada, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/917,991

(22) PCT Filed: Sep. 11, 2014

(86) PCT No.: PCT/JP2014/074022
§ 371 (c)(1),
(2) Date: Mar. 10, 2016

(87) PCT Pub. No.: WO2015/037646
PCT Pub. Date: Mar. 19, 2015

(65) Prior Publication Data

US 2016/0221353 A1 Aug. 4, 2016

(30) Foreign Application Priority Data

Sep. 12, 2013 (JP) ..... 2013-189654

(51) Int. Cl.
*B41J 2/165* (2006.01)
*B41J 2/175* (2006.01)

(52) U.S. Cl.
CPC ..... *B41J 2/17596* (2013.01); *B41J 2/1652* (2013.01); *B41J 2/16508* (2013.01); *B41J 2/16523* (2013.01); *B41J 2/16552* (2013.01); *B41J 2002/16594* (2013.01)

(58) Field of Classification Search
CPC B41J 2/1652; B41J 2/16523; B41J 2/16552; B41J 2002/16594; B41J 2/17566; B41J 2/17596; B41J 2/18; B41J 2/185; B41J 2002/1853
See application file for complete search history.

(56) References Cited

U.S. PATENT DOCUMENTS 5,561,448 A * 10/1996 Kaneko ..... B41J 2/16508 347/29
5,943,078 A 8/1999 Nishimoto et al.
6,179,406 B1 * 1/2001 Ito ..... B41J 2/1707 347/35

(Continued)

FOREIGN PATENT DOCUMENTS

JP 57-128561 A 8/1982
JP 63-260451 A 10/1988

(Continued)

OTHER PUBLICATIONS

Official Communication issued in International Patent Application No. PCT/JP2014/074022, mailed on Dec. 9, 2014.

*Primary Examiner* — Anh T. N. Vo
(74) *Attorney, Agent, or Firm* — Keating and Bennett, LLP

(57) ABSTRACT

The present invention provides an inkjet printer capable of allowing fluids, such as ink, cleaning liquid, and air, to suitably flow into an ink path. The inkjet printer includes an ink path (16, 18, 28), valves (22, 26), a suction device, and a controller. The controller includes: a first control section to perform a first operation in which the suction device is driven for a first time period, with the valve (22) closed and the valve (26) opened; and a second control section to perform, after the first operation, a second operation in which the suction device is driven for a second time period, with the valve (22) opened and the valve (26) closed.

10 Claims, 21 Drawing Sheets

(56) References Cited

U.S. PATENT DOCUMENTS

| | | | | |
|---|---|---|---|---|
| 6,981,761 | B2 * | 1/2006 | Usui | B41J 2/1652 347/85 |
| 7,556,367 | B2 * | 7/2009 | Langford | B41J 2/17509 347/89 |
| 8,128,212 | B2 * | 3/2012 | Katada | B41J 2/175 347/89 |
| 2002/0175969 | A1 | 11/2002 | Suzuki | |
| 2006/0050113 | A1 | 3/2006 | Sakurai | |
| 2010/0327025 | A1 | 12/2010 | Yokoyama et al. | |

FOREIGN PATENT DOCUMENTS

| | | | |
|---|---|---|---|
| JP | 08-150730 | A | 6/1996 |
| JP | 09-262972 | A | 10/1997 |
| JP | 2002-029041 | A | 1/2002 |
| JP | 2002-347256 | A | 12/2002 |
| JP | 2006-076049 | A | 3/2006 |
| JP | 2006-130858 | A | 5/2006 |
| JP | 2011-011383 | A | 1/2011 |
| JP | 2013-071296 | A | 4/2013 |

* cited by examiner

INKJET PRINTER

TECHNICAL FIELD

The present invention relates to inkjet printers.

This application claims priority to Patent Application No. 2013-189654 filed in Japan on Sep. 12, 2013, the entire contents of which are hereby incorporated by reference.

BACKGROUND ART

Inkjet printers, which perform printing using inkjet techniques, are known in the art. Such an inkjet printer includes an ink supply path connecting an ink cartridge serving as an ink source to an ink head. Such an ink supply path will hereinafter be simply referred to as an "ink path". For example, Patent Document 1 discloses an inkjet printer including: two ink cartridges; an ink head; and an ink path connecting the ink cartridges to the ink head. When one of the ink cartridges is empty, this inkjet printer allows ink to be supplied from the other ink cartridge. This enables ink cartridge replacement without suspending printing.

CITATION LIST

Patent Document

Patent Document 1: JP 2002-29041 A

SUMMARY OF INVENTION

Technical Problem

For example, when an inkjet printer including an ink path such as one disclosed in Patent Document 1 undergoes maintenance, the ink path may be filled with ink, ink may be drained from the ink path, and/or the ink path may be cleaned with cleaning liquid. Studies conducted by the inventor suggest that such work may lead to an increase in wasteful ink consumption or may result in insufficient draining of ink or cleaning liquid. These disadvantages will be specifically described below with reference to the drawings.

FIG. 18 is a schematic diagram of an ink path known in the art. An ink path 150 includes: two tubes 106 and 108; and a tube 118 connecting the tubes 106 and 108 to each other. One end 106*c* of the tube 106 is connected to an ink cartridge 102. The other end 106*d* of the tube 106 is connected to an ink head 100. One end 108*c* of the tube 108 is connected to an ink cartridge 104. The other end 108*d* of the tube 108 is connected to the ink head 100. The tubes 106 and 108 are respectively provided with valves 112 and 116.

For example, when the ink cartridges 102 and 104 are respectively connected to the tubes 106 and 108 of the ink path 150 included in the inkjet printer, the tubes 106, 108, and 118 are first filled with ink. Specifically, with the valves 112 and 116 opened, a pump (not illustrated) applies suction through a lower surface 100*a* of the ink head 100.

In this case, however, ink suction may vary due to, for example, the locations and shapes of the tubes 106, 108, and 118. This may cause a larger amount of ink to be sucked through one of the tubes that is more suited for suction. For example, supposing that the tube 106 is more suited for suction than the tube 108, ink sucked from the ink cartridge 102 first flows into an upstream region 106*a* of the tube 106 as illustrated in FIG. 19(*a*). The ink is subsequently divided at a connection P1 into ink flowing into the tube 118 and ink flowing into a downstream region 106*b*. The ink, which has flowed into the tube 118, flows into a downstream region 108*b* of the tube 108 through a connection P2 and then enters the ink head 100 as illustrated in FIG. 19(*b*). The ink, which has flowed into the downstream region 106*b*, enters the ink head 100. Subsequent continuous suction by the pump also causes ink to be sucked little by little from the ink cartridge 104 connected to the tube 108 less suited for suction. The ink sucked from the ink cartridge 104 flows into an upstream region 108*a* of the tube 108. During this process, ink is constantly sucked from the ink cartridge 102 connected to the tube 106, and is thus continuously discharged from the ink head 100.

Because ink is sucked in this manner, the conventional ink filling method unfortunately increases wasteful ink consumption. The amount of ink remaining in the ink cartridges 102 and 104 is typically calculated on the basis of a time period during which ink is sucked in the above-described manner, assuming that the amount of ink discharged from the ink cartridge 102 and the amount of ink discharged from the ink cartridge 104 are equal during the suction. Thus, the wasteful ink consumption increased as just mentioned, for example, makes it difficult to accurately determine the amount of remaining ink.

If uniform suction is enabled through the tubes 106 and 108, other problems may still occur. Specifically, ink sucked from the ink cartridge 102 flows into the upstream region 106*a* of the tube 106, the connection P1, and the downstream region 106*b* of the tube 106 in this order, and then reaches the ink head 100. Ink sucked from the ink cartridge 104 flows into the upstream region 108*a* of the tube 108, the connection P2, and the downstream region 108*b* of the tube 108 in this order, and then reaches the ink head 100. Thus, a center region of the tube 118 is filled with no ink as illustrated in FIG. 19(*c*). This creates an air layer or air bubbles in the tube 118. Such air bubbles may flow into the ink head 100, causing a malfunction, such as a print failure.

In replacing the ink cartridges 102 and 104, for example, ink is drained from the tubes 106, 108, and 118. Specifically, the ink cartridges 102 and 104 are respectively detached from the tubes 106 and 108, and then the pump (not illustrated) applies suction to ink in the tubes 106, 108, and 118 through the lower surface 100*a* of the ink head 100, with the valves 112 and 116 opened.

Suction through the tubes 106 and 108, however, may vary as mentioned above. In that case, ink may not be completely drainable from one of the tubes that is less suited for suction. For example, supposing that the tube 106 is more suited for suction than the tube 108, suction by the pump starts, with the tubes 106, 108, and 118 filled with ink as illustrated in FIG. 20(*a*). Then, ink in the downstream regions 106*b* and 108*b* first flows into the ink head 100. Subsequently, ink in the tube 118 flows into the downstream region 108*b*. Ink in the upstream region 106*a* flows into the downstream region 106*b* and the tube 118, allowing air to flow into the upstream region 106*a* as illustrated in FIG. 20(*b*). In this state, ink still remains in the upstream region 108*a*. Subsequent further suction by the pump causes the ink in the downstream regions 106*b* and 108*b* to flow into the ink head 100. The ink in the tube 118 flows into the downstream region 108*b*. Thus, the ink is drained from the ink path except the upstream region 108*a* as illustrated in FIG. 20(*c*). If suction by the pump is continued in this state, air will be continuously sucked from the tube 106, making it difficult to drain the ink from the upstream region 108*a* of the tube 108.

If uniform suction is enabled through the tubes 106 and 108, ink may still disadvantageously remain. Specifically, once suction by the pump starts, ink in the downstream regions 106*b* and 108*b* flows into the ink head 100. Ink in the upstream regions 106*a* and 108*a* respectively flow through the downstream regions 106*b* and 108*b* into the ink head 100, and a portion of ink in the tube 118 flows through the downstream region 108*b* into the ink head 100. Thus, the ink may still remain in the center region of the tube 118 as illustrated in FIG. 20(*d*). Further continuous suction by the pump in this state causes air to be continually sucked uniformly through the tubes 106 and 108, making it difficult to drain the ink remaining in the tube 118.

The inside of the tubes 106, 108, and 118 is cleaned prior to supplying ink of a different color to the ink head 100, for example. Specifically, cartridges 120 and 122 storing cleaning liquid are first respectively attached to the tubes 106 and 108 so that the cartridges 120 and 122 respectively take the place of the ink cartridges 102 and 104 as illustrated in FIG. 21(*a*). Then, with the valves 112 and 116 opened, the pump (not illustrated) applies suction through the lower surface 100*a* of the ink head 100. In this operation, irrespective of whether the ink path 150 is filled with ink, the cleaning liquid and air have to be allowed to alternately flow into the tubes 106, 108, and 118 so as to eventually drain the ink and cleaning liquid with reliability.

Suction through the tubes 106 and 108, however, may vary as mentioned above. In that case, the tube less suited for suction may be cleaned insufficiently.

For example, suppose that the tube 106 is more suited for suction than the tube 108, and suction by the pump starts, with the tubes 106, 108, and 118 filled with ink as illustrated in FIG. 21(*a*). Then, as illustrated in FIG. 21(*b*), cleaning liquid flows from the cartridge 120 into the upstream region 106*a* similarly to the corresponding step of the ink filling operation illustrated in FIG. 19(*a*).

Subsequently, suction is applied by the pump, with the cartridges 120 and 122 respectively detached from the tubes 106 and 108. Then, the ink in the downstream regions 106*b* and 108*b* flows into the ink head 100. The ink in the tube 118 flows into the downstream region 108*b*. As illustrated in FIG. 21(*c*), the cleaning liquid in the upstream region 106*a* is divided at the connection P1 into cleaning liquid flowing into the downstream region 106*b* and cleaning liquid flowing into the tube 118. This causes air to flow into the upstream region 106*a*, from which the cleaning liquid has been drained. Thus, the upstream region 106*a* is cleaned.

Then, the pump applies suction, with the cartridges 120 and 122 respectively attached to the tubes 106 and 108 again. The ink in the downstream region 108*b* flows into the ink head 100. The cleaning liquid in the downstream region 106*b* flows into the ink head 100. The cleaning liquid in the tube 118 flows into the downstream region 108*b*. As illustrated in FIG. 21(*d*), the air in the upstream region 106*a* is divided at the connection P1 into air flowing into the downstream region 106*b* and air flowing into the tube 118. This allows the cleaning liquid to flow from the cartridge 120 into the upstream region 106*a* so as to clean a portion of the downstream region 106*b* and a portion of the tube 118, in which the cleaning liquid remains.

The cleaning liquid sucking process and air sucking process thus described are performed repeatedly, thus alternately forming a cleaning liquid layer and an air layer in the tubes 106, 108, and 118. Moving the cleaning liquid layer and the air layer through the ink path 150 cleans the inside of the tubes 106, 108, and 118. After the cleaning has been finished, the cleaning liquid is drained from the ink path 150 in a manner similar to that in the ink draining process described above.

In this cleaning operation, the cleaning liquid or air may insufficiently flow into the tube 108 similarly to the ink filling or draining process described above. Consequently, as illustrated in FIG. 21(*e*), cleaning of the upstream region 108*a* of the tube 108 may be insufficient.

The present invention has been made in view of the above problems, and its object is to provide an inkjet printer that includes an ink path connecting a plurality of ink cartridges to an ink head, and is capable of allowing fluids, such as ink, cleaning liquid, and air, to suitably flow into the ink path.

Solution to Problem

An inkjet printer according to the present invention includes: an ink head to discharge ink; a first ink path including a first upstream end connectable with a first cartridge storing ink or cleaning liquid, and a first downstream end in communication with the ink head; a second ink path including a second upstream end connectable with a second cartridge storing ink or cleaning liquid, and a second downstream end in communication with the ink head; a third ink path including a first connection connected to the first ink path, and a second connection connected to the second ink path; a first valve disposed in a portion of the first ink path between the first upstream end and the first connection; a second valve disposed in a portion of the second ink path between the second upstream end and the second connection; a suction device attached to the ink head, the suction device being configured to apply suction to a fluid in the first ink path, the second ink path, and the third ink path through the ink head; and a controller to exercise control to open and close the first valve and the second valve, and activate and deactivate the suction device. The controller includes: a first control section to perform a first operation in which the suction device is driven for a first time period, with the first valve closed and the second valve opened; and a second control section to perform, after the first operation, a second operation in which the suction device is driven for a second time period, with the first valve opened and the second valve closed.

Effects of Invention

The present invention enables a fluid to be favorably supplied to an ink path. The present invention also enables the ink path to be suitably filled with ink. The present invention further enables ink to be suitably drained from the ink path. The present invention still further enables suitable cleaning of the ink path.

DESCRIPTION OF EMBODIMENTS

An embodiment of the present invention will be described in detail below with reference to the drawings. The embodiment described below is naturally not intended to limit the present invention. Components or elements having the same functions are identified with the same reference signs, and description thereof will be omitted or simplified if deemed redundant.

As used herein, the term "medium" refers to any of various materials including resin materials, such as PVC and polyester, and substances, such as aluminum, iron, and wood, as well as various recording media including paper products, such as plain paper.

As used herein, the term "inkjet" refers to a printing method involving any of various inkjet techniques known in the art, including various continuous methods, such as a binary deflection method and a continuous deflection method, and various on-demand methods, such as a thermal method and a piezoelectric method.

As used herein, the term "main scanning direction" refers to the width direction of a medium, such as a recording paper. The term "sub-scanning direction" refers to a direction perpendicular to the main scanning direction, i.e., a direction in which a medium, such as a recording paper, is to be conveyed and the longitudinal direction of the medium.

Figure 1:
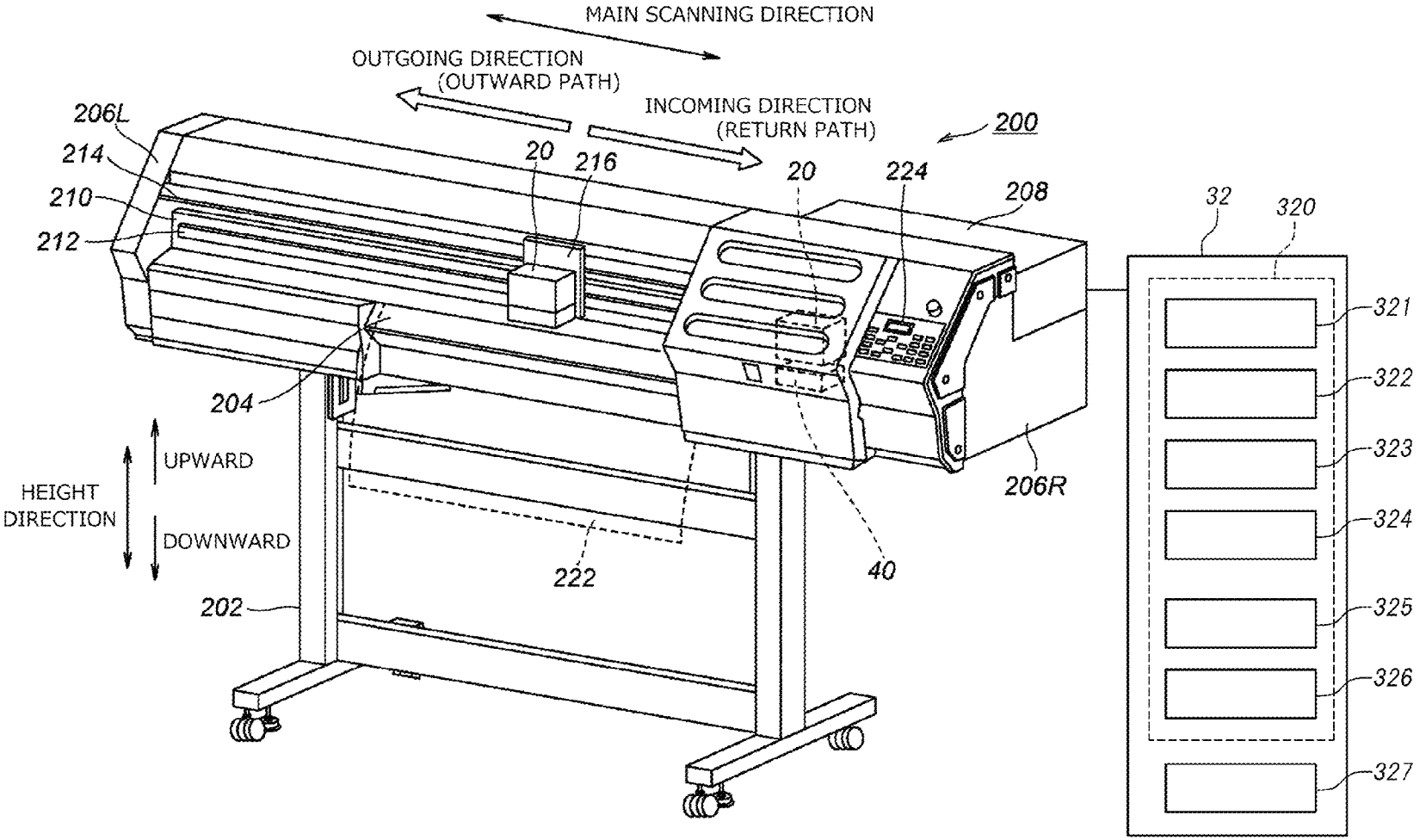
FIG. 1 is a perspective view of an inkjet printer according to an embodiment of the present invention.

FIG. 1 is a schematic perspective view of an inkjet printer. As illustrated in FIG. 1, an inkjet printer 200 includes a base member 204, lateral members 206R and 206L, a lateral unit 208, a center wall 210, a guide rail 212, a wire 214, a holder 216, and an ink head 20.

The base member 204 is supported on a base stand 202. The base member 204 extends in the main scanning direction. The lateral members 206R and 206L are respectively disposed on the right and left ends of the base member 204. The lateral unit 208 is disposed laterally of the lateral member 206R. The lateral unit 208 includes, on its surface, a display 224. The center wall 210 connects two right and left lateral members, i.e., the lateral members 206R and 206L, to each other. The guide rail 212 is disposed on a surface of the center wall 210. The guide rail 212 extends in the main scanning direction. The wire 214 extends in parallel with the surface of the center wall 210. The wire 214 is movable in the main scanning direction. The holder 216 is fixed onto the wire 214. The holder 216 is slidably placed on the guide rail 212. The ink head 20 is disposed on the holder 216. The ink head 20 faces a recording paper 222 on the base member 204.

The recording paper 222 is used as a medium in this embodiment. The recording paper 222 is fed onto the base member 204 by a paper feeder (not illustrated). The recording paper 222 is conveyed in the direction perpendicular to the main scanning direction, i.e., in the longitudinal direction of the recording paper 222.

The inkjet printer 200 further includes a microcomputer 32. The microcomputer 32 controls all operations of the inkjet printer 200. The microcomputer 32 functions as a controller 320 and an ink remaining amount calculator 327 (which will be described in detail below). The controller 320 includes a first control section 321, a second control section 322, a third control section 323, a fourth control section 324, a counting section 325, and a determination section 326.

The inkjet printer 200 performs printing on the recording paper 222 in accordance with control exercised by the microcomputer 32. Specifically, the paper feeder (not illustrated) first feeds the recording paper 222 onto the base member 204. The wire 214 is wound up by, for example, driving a motor (not illustrated), and thus moved along the center wall 210. The movement of the wire 214 causes the ink head 20, mounted on the holder 216, to reciprocate above the recording paper 222 in the outgoing direction (or outward path) and the incoming direction (or return path) along the main scanning direction. The ink head 20 discharges ink onto the recording paper 222 while reciprocating, thus enabling printing on the recording paper 222.

The lateral unit 208 of the inkjet printer 200 is provided with a capping device 40. The capping device 40 is disposed so that when the ink head 20 is at a standby position, for example, inkjet nozzles (not illustrated) on the lower surface of the ink head 20 are capped with the capping device 40. The lateral unit 208 is further provided with an ink path. The term "ink path" refers to a path through which ink is supplied from an attachable and detachable ink cartridge to the ink head 20.

Figure 2:
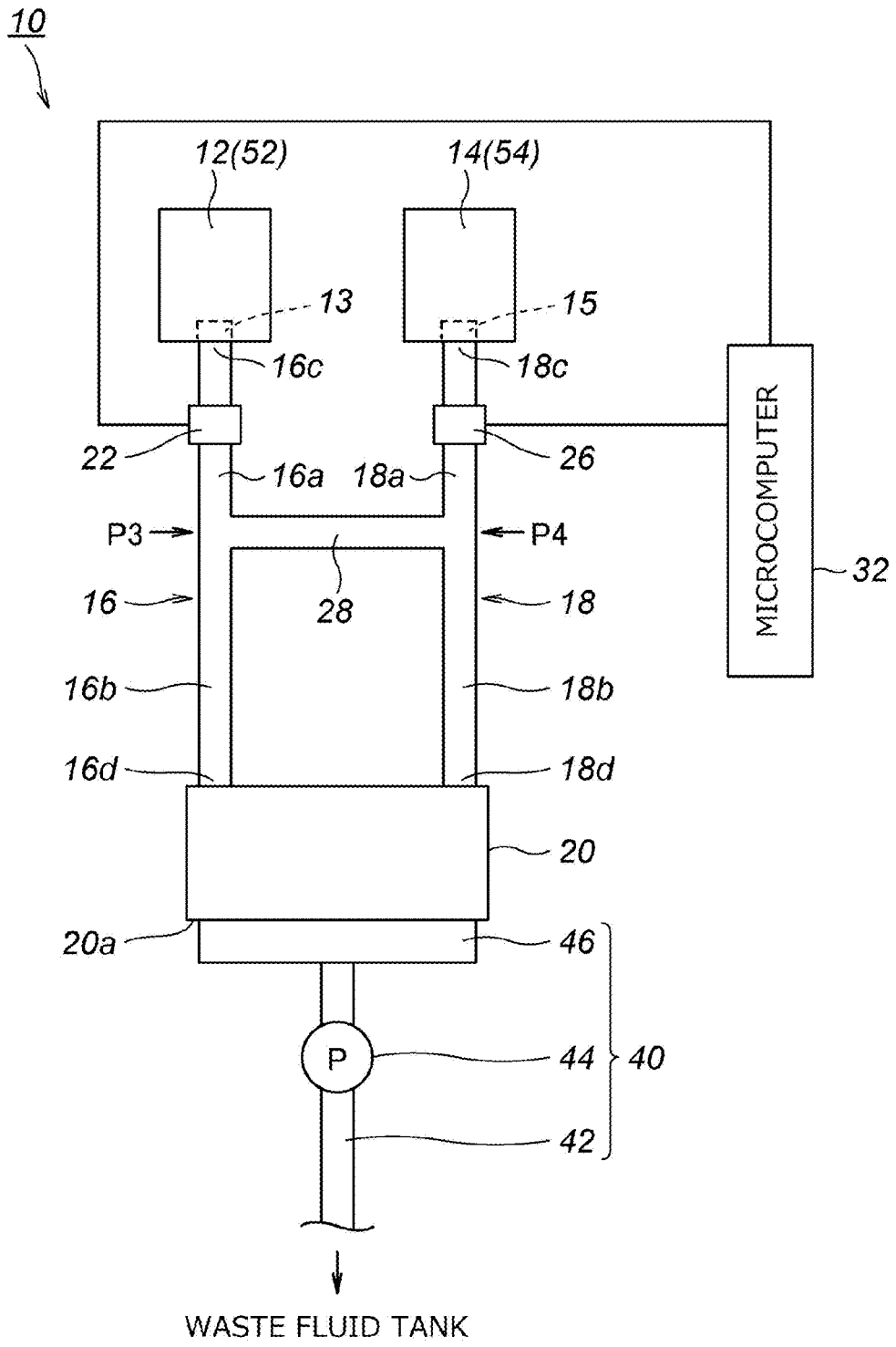
FIG. 2 is a schematic diagram of an ink path in the inkjet printer illustrated in FIG. 1.

FIG. 2 is a schematic diagram of an ink path 10 in the inkjet printer 200. As illustrated in FIG. 2, the ink path 10 includes a tube 16, a tube 18, and a tube 28 connecting the tubes 16 and 18 to each other. One end 16*c* of the tube 16 is detachably connected to an ink cartridge 12 (or a cleaning liquid cartridge 52, which will be described below). The other end 16*d* of the tube 16 is connected to the ink head 20. One end 18*c* of the tube 18 is detachably connected to an ink cartridge 14 (or a cleaning liquid cartridge 54, which will be described below). The other end 18*d* of the tube 18 is connected to the ink head 20.

The tube 16 is an example of a "first ink path", the tube 18 is an example of a "second ink path", and the tube 28 is an example of a "third ink path". The end 16*c* is an example of a "first upstream end", and the end 16*d* is an example of a "first downstream end". The end 18*c* is an example of a "second upstream end", and the end 18*d* is an example of a "second downstream end".

The ink cartridges 12 and 14 store ink of the same color. The ink cartridges 12 and 14 are respectively connected to the tubes 16 and 18 via adaptors (not illustrated) provided in the lateral unit 208 (FIG. 1). The lower surfaces of the ink cartridges 12 and 14 are respectively provided with sensors 13 and 15. The sensors 13 and 15 are connected with the microcomputer 32. When the ink cartridge 12 has run out of ink, the sensor 13 transmits an "ink out" signal to the microcomputer 32. When the ink cartridge 14 has run out of ink, the sensor 15 transmits an "ink out" signal to the microcomputer 32.

The cleaning liquid cartridges 52 and 54 store cleaning liquid capable of dissolving the ink. The cleaning liquid cartridges 52 and 54 are respectively connected to the tubes 16 and 18 via the adaptors (not illustrated) provided in the lateral unit 208 (FIG. 1).

The tube 16 is provided with a valve 22 upstream of a connection P3 with the tube 28 in an ink sucking direction. The tube 18 is provided with a valve 26 upstream of a connection P4 with the tube 28 in the ink sucking direction. The connection P3 is an example of a "first connection", and the connection P4 is an example of a "second connection". The valve 22 is an example of a "first valve", and the valve 26 is an example of a "second valve". A region of the tube 16 upstream of the connection P3 in the ink sucking direction, i.e., a region of the tube 16 adjacent to its connection with the ink cartridge 12, will hereinafter be referred to as an "upstream region 16*a*". A region of the tube 18 upstream of the connection P4 in the ink sucking direction, i.e., a region of the tube 18 adjacent to its connection with the ink cartridge 14, will hereinafter be referred to as an "upstream region 18*a*". A region of the tube 16 downstream of the connection P3 in the ink sucking direction, i.e., a region of the tube 16 adjacent to its connection with the ink head 20, will hereinafter be referred to as a "downstream region 16*b*". A region of the tube 18 downstream of the connection P4 in the ink sucking direction, i.e., a region of the tube 18 adjacent to its connection with the ink head 20, will hereinafter be referred to as a "downstream region 18*b*". The valves 22 and 26 are connected with the microcomputer 32 (FIG. 1). The microcomputer 32 exercises control to open and close the valve 22, and open and close the valve 26.

The ink head 20 includes a lower surface 20*a* on which inkjet nozzles (not illustrated) are provided. The capping device 40, which caps the inkjet nozzles, is disposed around the inkjet nozzles. The capping device 40 includes a cap 46, a pump (suction device) 44, and a tube 42, which are arranged in this order from the lower surface 20*a* of the ink head 20. The tube 42 is in communication with a waste fluid tank.

The pump 44 is used in filling the ink path 10 with ink supplied from the ink cartridges 12 and 14, draining ink from the ink path 10, and cleaning the ink path 10. Specifically, the ink head 20 is moved to the lateral unit 208 (FIG. 1) to cap the lower surface 20*a* of the ink head 20 with the cap 46. In this state, the pump 44 is operated to apply suction. The pump 44 is connected with the microcomputer 32. The microcomputer 32 exercises control to activate and deactivate the pump 44.

The microcomputer 32 is configured to enable switching between a first state (i) and a second state (ii) described below.

In the first state (i), with a predetermined one of the valves 22 and 26 closed and the other one of the valves 22 and 26 opened, the pump 44 applies suction through the ink head 20 for a first time period.

In the second state (ii), with the predetermined one of the valves 22 and 26 opened and the other one of the valves 22 and 26 closed, the pump 44 applies suction through the ink head 20 for a second time period.

As used herein, the term "fluid" is a generic term for liquid and gas. Exemplary fluids include ink, cleaning liquid, and air.

Referring to FIGS. 3 to 16, a specific description will be given of the following methods:

(1) A method for filling the ink path 10 with ink;

(2) A method for draining ink from the ink path 10 (i.e., a method for filling the ink path 10 with air); and (3) A method for cleaning the ink path 10.

(1) Method for Filling Ink Path with Ink

A worker operates an operating element (not illustrated) of the inkjet printer 200 so as to provide an instruction for filling the ink path 10 with ink. In response to this instruction, the lower surface 20*a* of the ink head 20 is capped with the capping device 40 (FIG. 2) so as to start an ink filling process. Examples of the operating element include an operating button.

First Exemplary Ink Filling Process

Figure 3:
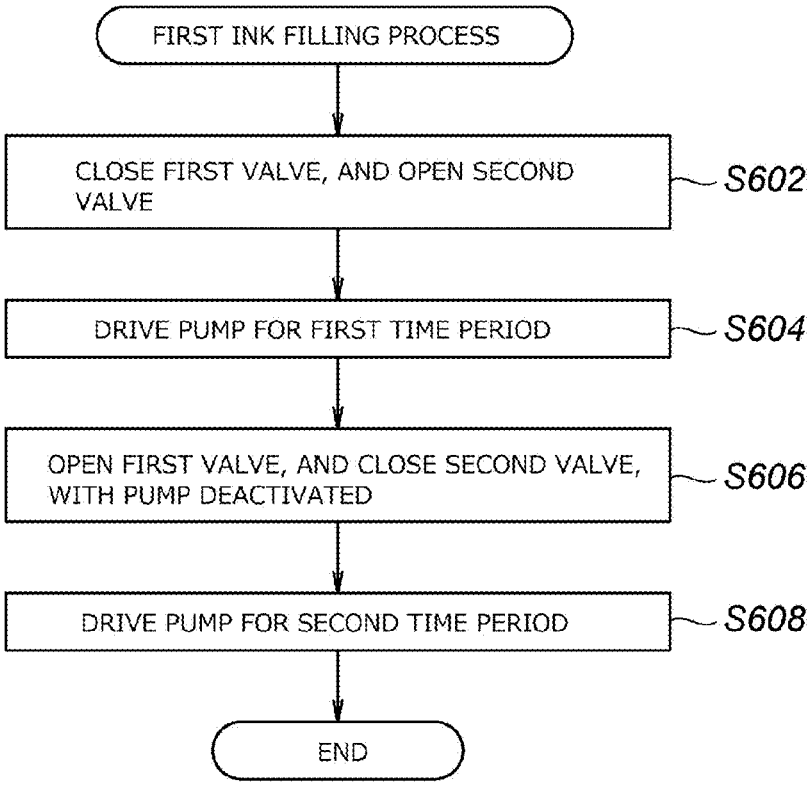
FIG. 3 is a flowchart illustrating the procedure of a first ink filling process.
Figure 4:
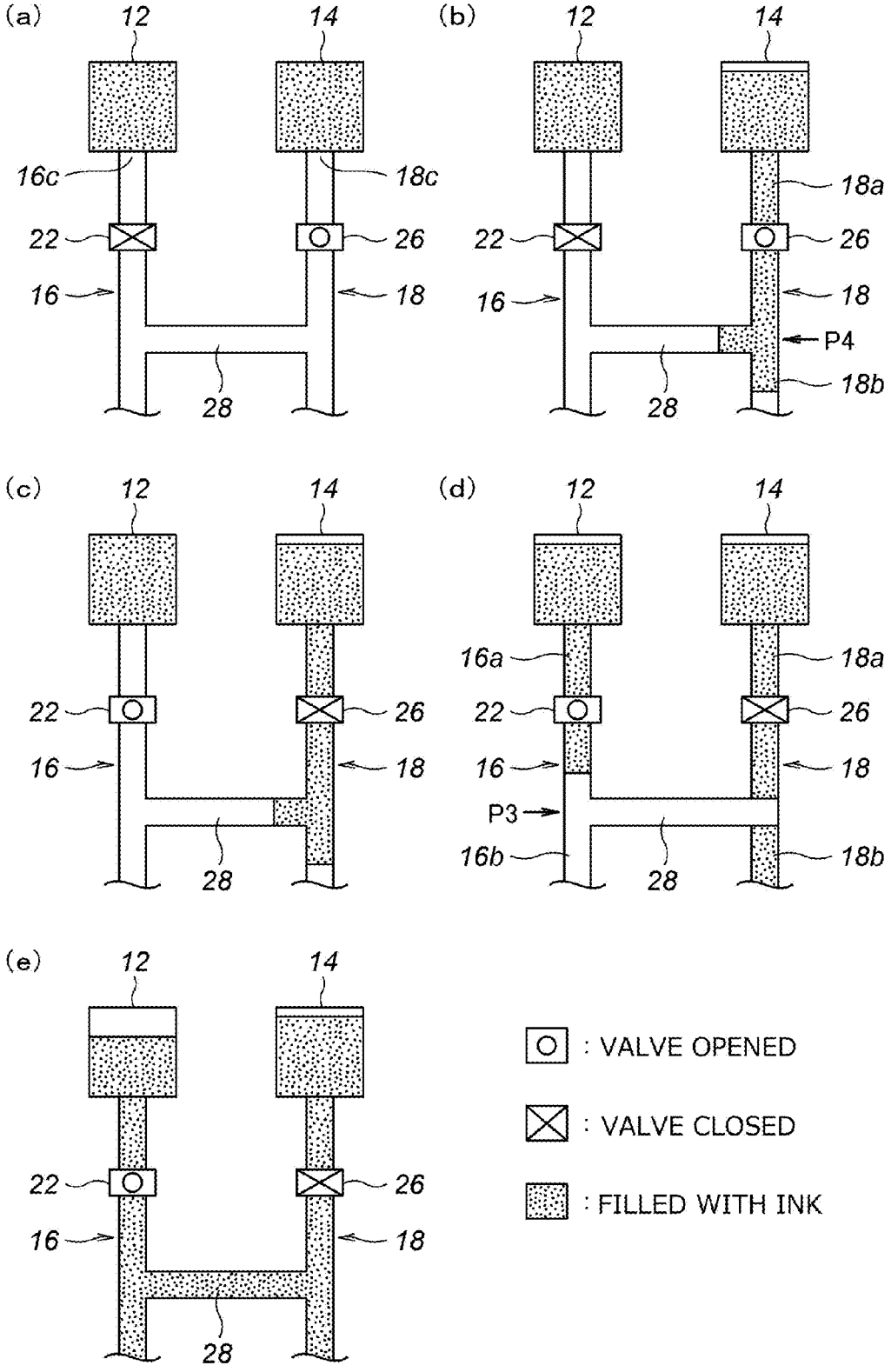
FIGS. 4(*a*) to 4(*e*) are schematic diagrams illustrating how the ink path is filled with ink in the first ink filling process.

FIG. 3 is a flowchart illustrating the procedure of a first exemplary ink filling process, i.e., a first ink filling process. FIGS. 4(*a*) to 4(*e*) are schematic diagrams illustrating how the ink path is filled with ink in the first ink filling process.

As illustrated in FIG. 4(*a*), at the start of the first ink filling process, the end 16*c* of the tube 16 is connected to the ink cartridge 12, and the end 18*c* of the tube 18 is connected to the ink cartridge 14.

The first ink filling process starts from step S602, in which the valve 22 is closed and the valve 26 is opened as illustrated in FIG. 4(*a*).

In step S604, the pump 44 of the capping device 40 (FIG. 2) is driven for a first time period. Specifically, after a lapse of the first time period from the start of driving of the pump 44, the pump 44 is deactivated. Thus, a predetermined amount of ink is sucked from the ink cartridge 14.

Driving the pump 44 first causes ink to be sucked into the upstream region 18*a* of the tube 18 from the ink cartridge 14. The ink is then divided at the connection P4 into ink flowing into the tube 28 and ink flowing into the downstream region 18*b* of the tube 18.

The amount of ink to be sucked from the ink cartridge 14 is set so as to fill at least a portion of the tube 18 between the end 18*c* and the connection P4 with the ink. In this process, the amount of ink to be sucked from the ink cartridge 14 is set so as to fill the upstream region 18*a* of the tube 18, a portion of the downstream region 18*b*, and a portion of the tube 28 with the ink as illustrated in FIG. 4(*b*). The amount of ink to be sucked is adjustable by changing the first time period during which the pump 44 is to be driven. The first time period, for example, is experimentally calculated and stored in the microcomputer 32 in advance. The first time period may be 10 seconds, for example.

In step S606, with the pump 44 deactivated, the valve 22 is opened and the valve 26 is closed as illustrated in FIG. 4(*c*).

In step S608, the pump 44 is driven for a second time period. Specifically, after a lapse of the second time period from the start of driving of the pump 44, the pump 44 is deactivated.

As illustrated in FIG. 4(*d*), driving the pump 44 first causes ink to be sucked into the upstream region 16*a* of the tube 16 from the ink cartridge 12. During this ink suction, the ink in a portion of the downstream region 18*b* moves to the ink head 20, and the ink in a portion of the tube 28 moves to the downstream region 18*b*. The ink in the upstream region 18*a*, however, does not move, because the valve 26 is closed. The ink, sucked from the ink cartridge 12, flows through the upstream region 16*a* of the tube 16 and is divided at the connection P3 into ink flowing into the downstream region 16*b* of the tube 16 and ink flowing into the tube 28. The ink, which has flowed into the downstream region 16*b* of the tube 16, then reaches the ink head 20. The ink, which has flowed into the tube 28 and the downstream region 18*b* of the tube 18, then reaches the ink head 20. Consequently, as illustrated in FIG. 4(*e*), the tubes 16, 18, and 28 are filled with the ink.

The second time period is set so as to fill the tube 16, the tube 28, and the downstream region 18*b* of the tube 18 with ink. The second time period, for example, is experimentally calculated and stored in the microcomputer 32 in advance. The second time period is typically longer than the first time period, and may be 60 seconds, for example.

In this example, the microcomputer 32 functions as the first control section 321 in Steps S602 and S604, and functions as the second control section 322 in Steps S606 and S608. Steps S602 and S604 constitute an example of "step 1)" of an ink filling method. Steps S606 and S608 constitute an example of "step 2)" of the ink filling method.

The ink filling process thus disclosed reliably fills the ink path 10 with a predetermined amount of ink. In other words, this ink filling process minimizes ink consumption. This ink filling process also precludes the intrusion of air bubbles into the ink path 10, thus preventing a malfunction, such as a print failure.

The ink filling process thus disclosed enables the amount of ink usage required in filling the ink path 10 with ink to be calculated on the basis of the driving time of the pump 44 (i.e., the first time period and the second time period). The amount of ink usage for the ink cartridge 14 is calculated on the basis of the first time period. The amount of ink usage for the ink cartridge 12 is calculated on the basis of the second time period. Thus, the amount of ink remaining in the ink cartridge 12 and the amount of ink remaining in the ink cartridge 14 are each determined accurately. The microcomputer 32 functions as the ink remaining amount calculator 327 when calculating the amounts of ink remaining in the ink cartridges 12 and 14 on the basis of the driving time of the pump 44.

Second Exemplary Ink Filling Process

Figure 5:
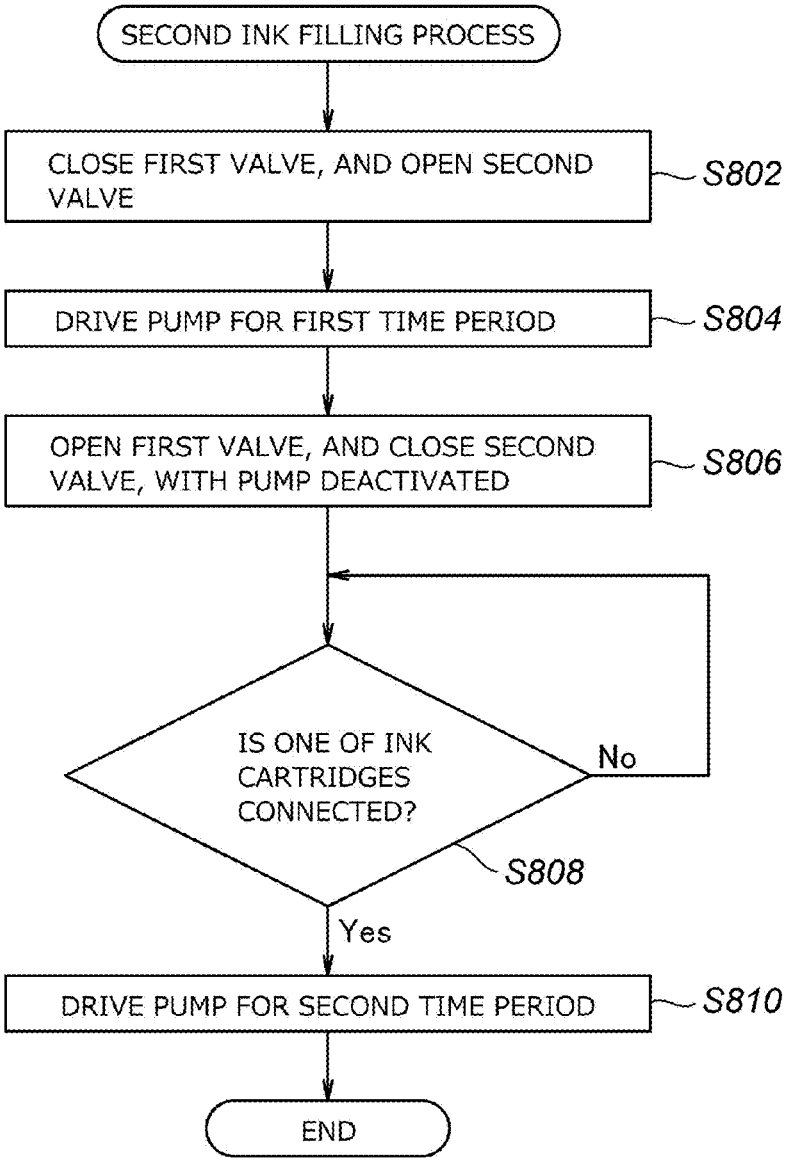
FIG. 5 is a flowchart illustrating the procedure of a second ink filling process.
Figure 6:
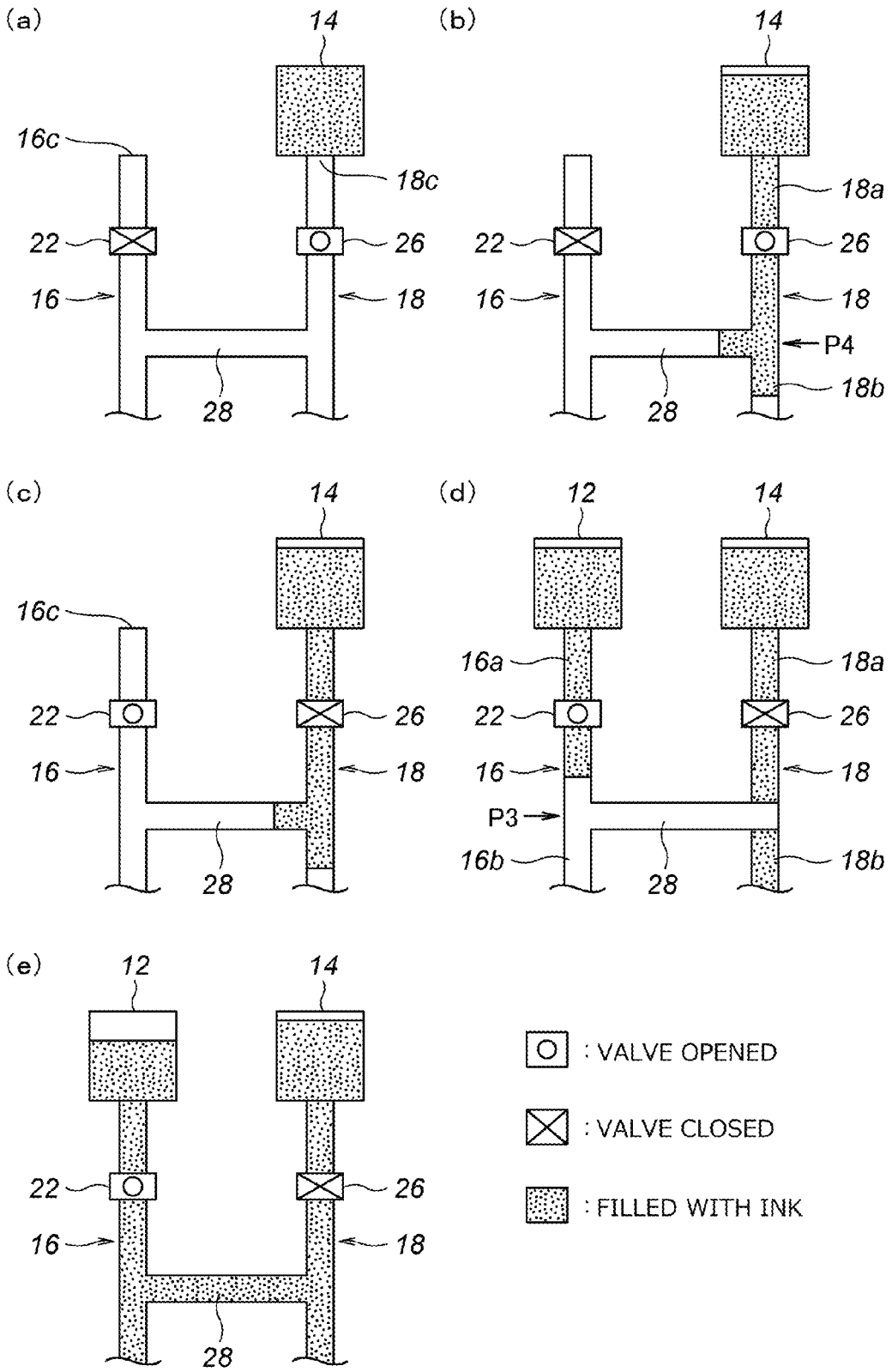
FIGS. 6(*a*) to 6(*e*) are schematic diagrams illustrating how the ink path is filled with ink in the second ink filling process.

FIG. 5 is a flowchart illustrating the procedure of a second exemplary ink filling process, i.e., a second ink filling process. FIGS. 6(*a*) to 6(*e*) are schematic diagrams illustrating how the ink path is filled with ink in the second ink filling process.

As illustrated in FIG. 6(*a*), at the start of the second ink filling process, the end 18*c* of the tube 18 is connected to the ink cartridge 14, but the end 16*c* of the tube 16 is connected to no ink cartridge. The end 16*c* of the tube 16 is open so that air is sucked into the tube 16.

The second ink filling process includes Steps S802, S804, S806, S808, and S810. Of these steps, steps S802, S804, S806, and S810 are respectively similar to steps S602, S604, S606, and S608 of the first ink filling process, and thus will not be described in detail. FIGS. 4(*a*) to 4(*e*) mentioned in the description of the first ink filling process may be respectively read as FIGS. 6(*a*) to 6(*e*).

After step S806, the microcomputer 32 determines in step S808 whether the end 16*c* of the tube 16 is connected with the ink cartridge 12. This determination is made on the basis of a detection result obtained by a sensor (not illustrated) configured to detect a connection between the tube 16 and the ink cartridge 12. The sensor is provided, for example, on the adaptor (not illustrated) through which the tube 16 and the ink cartridge 12 are connected to each other. The sensor detects whether the tube 16 is connected with the ink cartridge 12 (or the cleaning liquid cartridge 52, which will be described below).

Following a determination in step S808 that the tube 16 is not connected with the ink cartridge 12, step S808 is repeated. Specifically, step S808 is repeated until the determination in this step indicates that the tube 16 is connected with the ink cartridge 12. Alternatively, in response to the determination that the tube 16 is not connected with the ink cartridge 12, a prompt urging the worker to connect the ink cartridge 12 to the tube 16 may be presented, for example, on the display 224 (FIG. 2) of the inkjet printer 200.

When the determination in step S808 indicates that the tube 16 is connected with the ink cartridge 12, step S810 is performed as in the first ink filling process. Thus, the ink filling process ends.

In the second ink filling process thus disclosed, the tube 16 is not connected with the ink cartridge 12 when the valve 22 is opened in step S806. This precludes the flow of air (or air bubbles) into the ink cartridge 12, thus preventing a malfunction, such as a print failure, which has previously been described.

Third Exemplary Ink Filling Process

Figure 7:
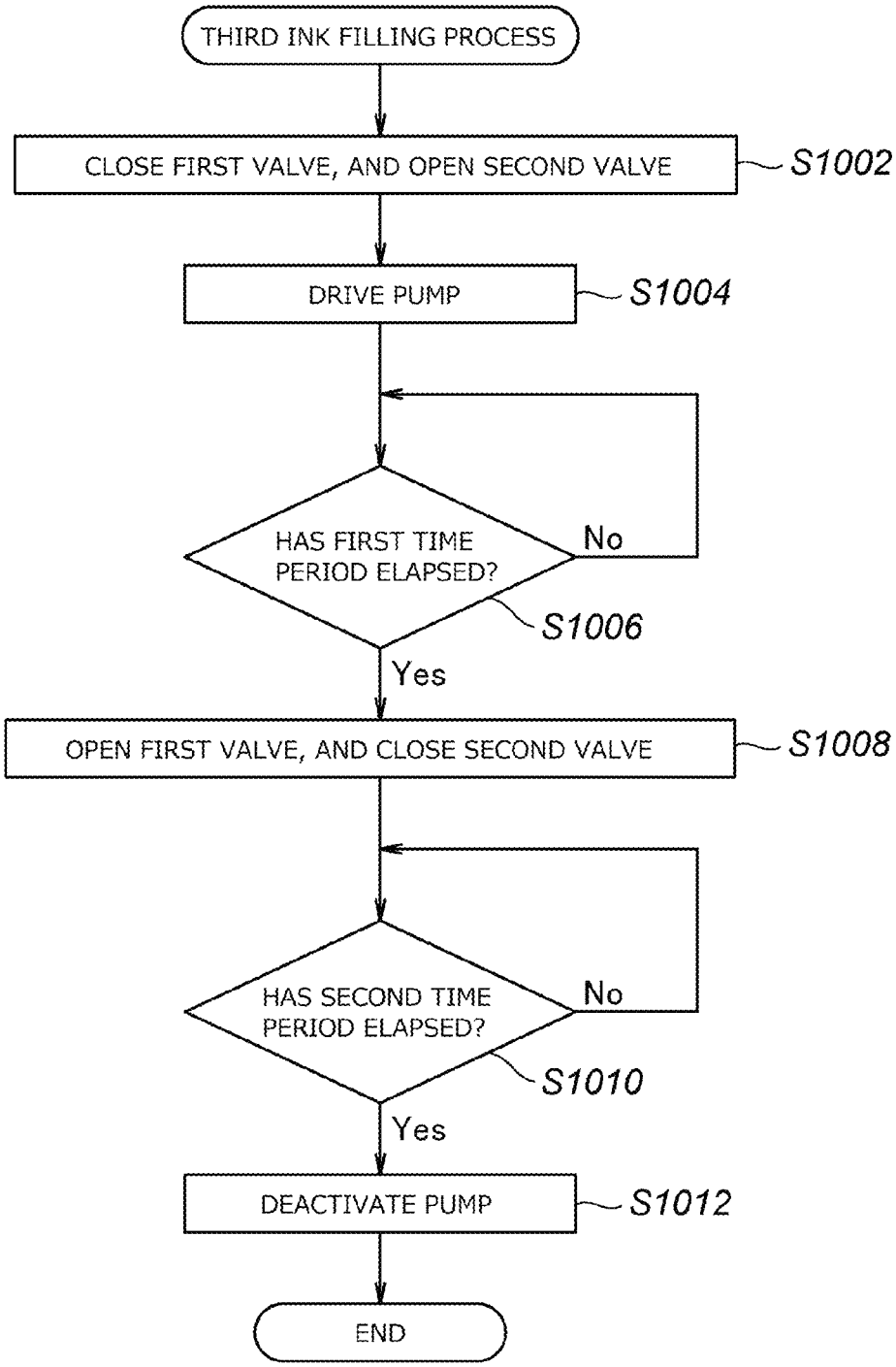
FIG. 7 is a flowchart illustrating the procedure of a third ink filling process.
Figure 8:
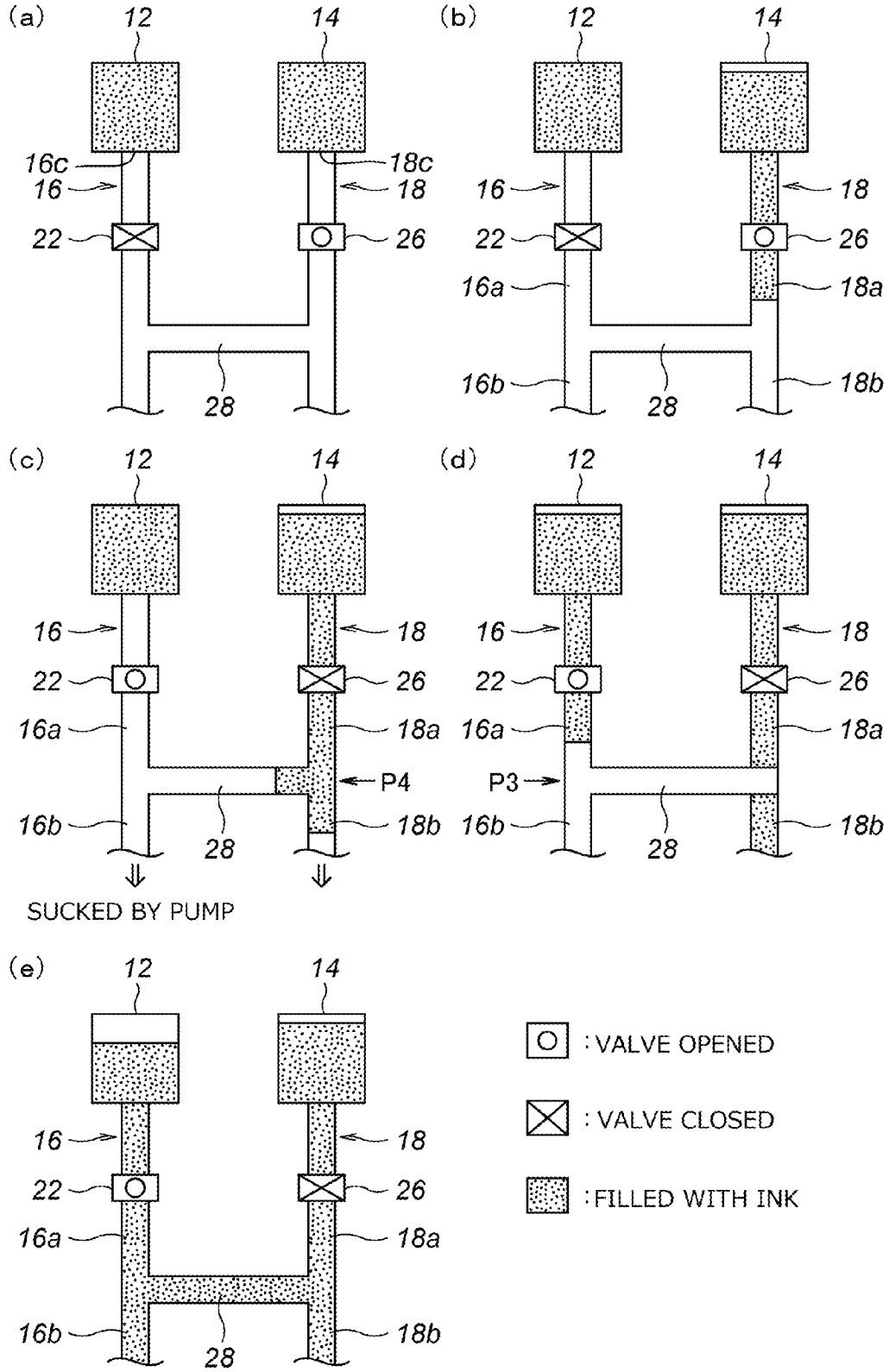
FIGS. 8(*a*) to 8(*e*) are schematic diagrams illustrating how the ink path is filled with ink in the third ink filling process.

FIG. 7 is a flowchart illustrating the procedure of a third exemplary ink filling process, i.e., a third ink filling process. FIGS. 8(*a*) to 8(*e*) are schematic diagrams illustrating how the ink path is filled with ink in the third ink filling process.

As illustrated in FIG. 8(*a*), at the start of the third ink filling process, the end 16*c* of the tube 16 is connected to the ink cartridge 12, and the end 18*c* of the tube 18 is connected to the ink cartridge 14.

In the third ink filling process, first, the valve 22 is closed and the valve 26 is opened in step S1002 as illustrated in FIG. 8(*a*). In step S1004, the pump 44 of the capping device 40 (FIG. 2) is driven. Driving the pump 44 causes ink to be sucked into the upstream region 18*a* of the tube 18 from the ink cartridge 14 as illustrated in FIG. 8(*b*).

In step S1006, the microcomputer 32 determines whether a first time period has elapsed. The first time period may be set in a manner similar to that used in the first exemplary ink filling process.

Following a determination that the first time period has not yet elapsed, step S1006 is repeated. Specifically, step S1006 is repeated until the determination in this step indicates that the first time period has elapsed.

Following a determination that the first time period has elapsed, step S1008 is performed. Specifically, with the pump 44 kept in the driven state, the microcomputer 32 opens the valve 22 and closes the valve 26 as illustrated in FIG. 8(*c*).

When the valve 22 is opened and the valve 26 is closed, ink is sucked into the upstream region 16*a* of the tube 16 from the ink cartridge 12 as illustrated in FIG. 8(*d*). The ink in the tube 28 moves to the downstream region 18*b* of the tube 18, and the ink in the downstream region 18*b* moves to the ink head 20. Because the valve 26 is closed, the ink in the upstream region 18*a* does not move.

In step S1010, the microcomputer 32 determines whether a second time period has elapsed. The second time period may be set in a manner similar to that used in the first exemplary ink filling process.

Following a determination that the second time period has not yet elapsed, step S1010 is repeated. Specifically, step S1010 is repeated until the determination in this step indicates that the second time period has elapsed.

Following a determination that the second time period has elapsed, step S1012 is performed. Specifically, assuming that the ink path 10 has been filled with ink, the pump 44 is deactivated. Thus, the ink filling process ends.

Upon lapse of the second time period after the valve 22 has been opened and the valve 26 has been closed, ink is further sucked from the state illustrated in FIG. 8(*d*). The ink sucked flows from the upstream region 16*a* to reach the ink head 20 through the downstream region 16*b* or through the tube 28 and the downstream region 18*b*. Thus, as illustrated in FIG. 8(*e*), the tubes 16, 18, and 28 are filled with the ink.

In the third ink filling process, suction is already applied by the pump 44 when the valve 22 is opened in step S1008. In other words, the suction device is activated in advance before the valves are opened or closed to allow switching to the second state. This precludes the flow of air (or air bubbles) into the ink cartridge 12, thus preventing a malfunction, such as a print failure, which has previously been described.

(2) Method for Draining Ink from Ink Path

The worker operates an operating element (not illustrated) of the inkjet printer 200 so as to provide an instruction for draining ink from the ink path 10. In response to this instruction, the lower surface 20*a* of the ink head 20 is capped with the capping device 40 (FIG. 2) so as to start an ink draining process. Although the following description is directed to draining of ink from the ink path 10, a fluid other than ink (e.g., cleaning liquid) may be drained from the ink path 10 in a manner similar to that described below.

First Exemplary Ink Draining Process

Figure 9:
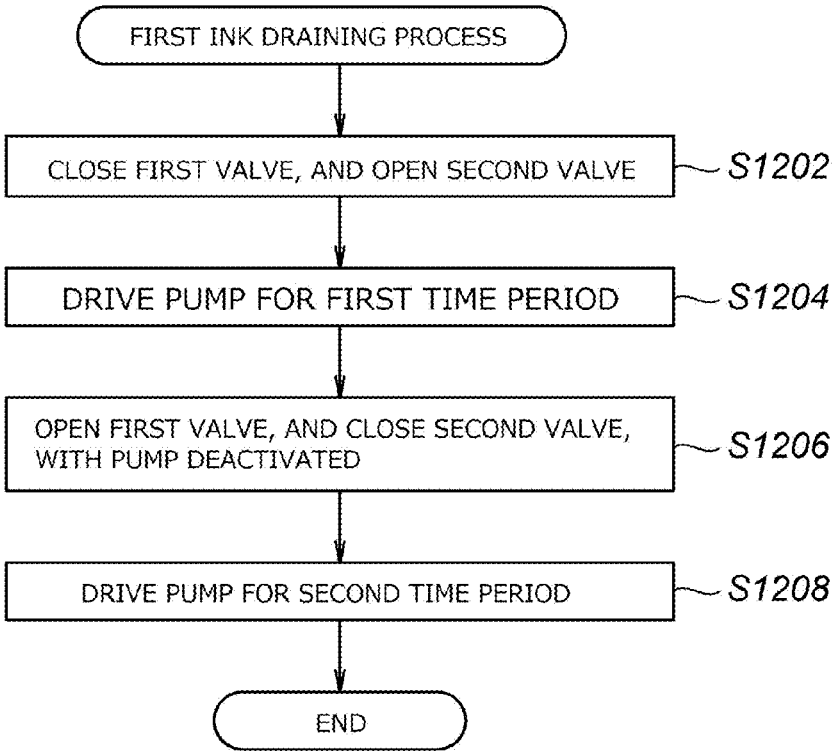
FIG. 9 is a flowchart illustrating the procedure of a first ink draining process.
Figure 10:
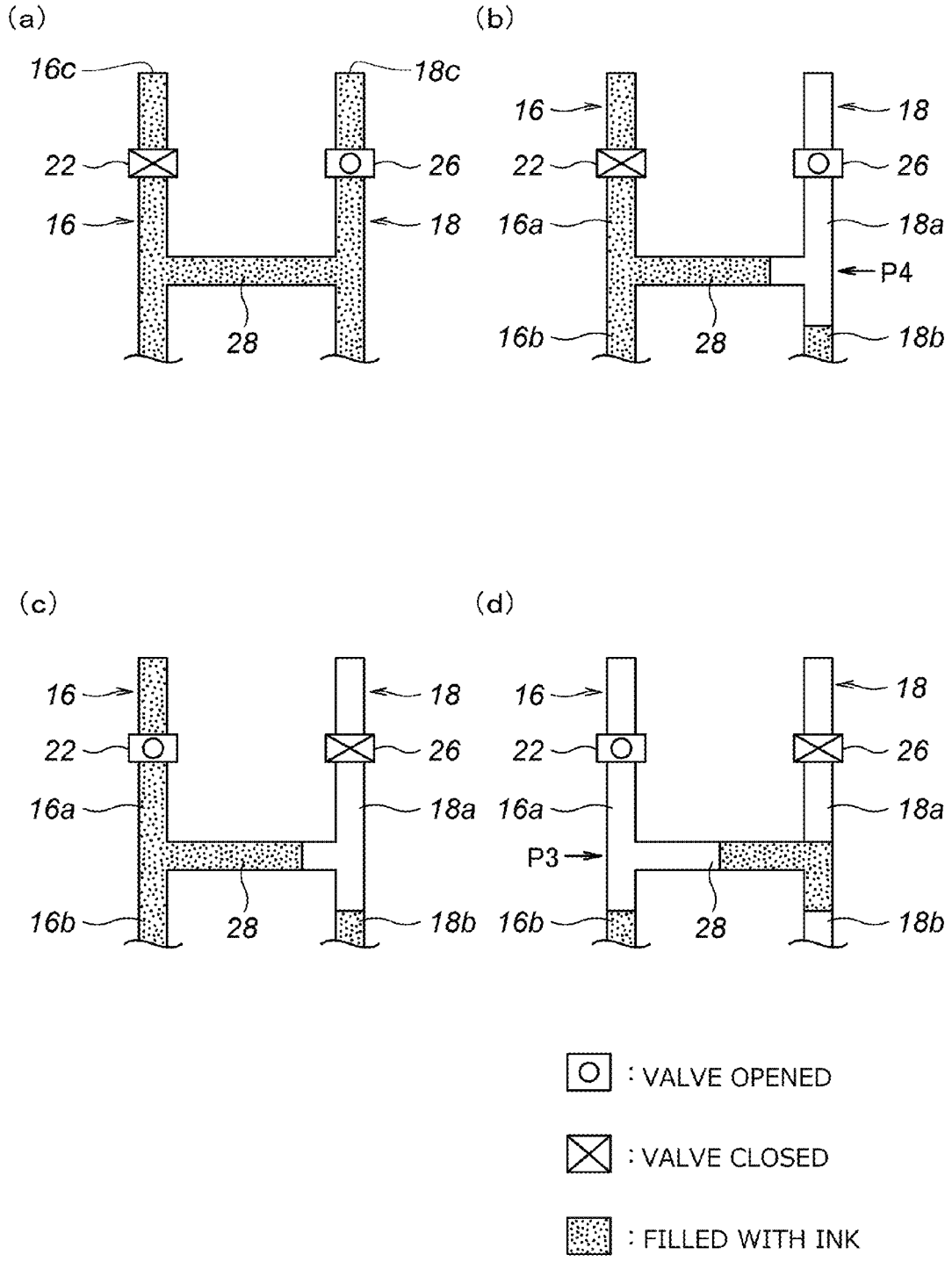
FIGS. 10(*a*) to 10(*d*) are schematic diagrams illustrating how ink is drained from the ink path in the first ink draining process.

FIG. 9 is a flowchart illustrating the procedure of a first exemplary ink draining process, i.e., a first ink draining process. FIGS. 10(*a*) to 10(*d*) are schematic diagrams illustrating how ink is drained from the ink path in the first ink draining process.

As illustrated in FIG. 10(*a*), at the start of the first ink draining process, the ink path 10 is filled with ink. The ink cartridges 12 and 14 are respectively detached from the ends 16*c* and 18*c* of the tubes 16 and 18.

In the first ink draining process, first, the valve 22 is closed and the valve 26 is opened in step S1202 as illustrated in FIG. 10(*a*).

In step S1204, the pump 44 of the capping device 40 is driven for a first time period. Specifically, after a lapse of the first time period from the start of driving of the pump 44, the pump 44 is deactivated.

Driving the pump 44 for the first time period causes the ink in the downstream region 18*b* of the tube 18 to move to the ink head 20, and causes the ink in the tube 28 to move to the downstream region 16*b*. As illustrated in FIG. 10(*b*), the ink in the upstream region 18*a* is divided at the connection P4 into ink flowing into the tube 28 and ink flowing into the downstream region 18*b* of the tube 18. Thus, a predetermined amount of ink is drained from the upstream region 18*a* of the tube 18, a portion of the downstream region 18*b*, and a portion of the tube 28.

The term "first time period" in this case refers to a time period that allows ink to be drained from these regions or portions. In other words, the first time period is set so as to drain ink from at least a portion of the tube 18 between the end 18*c* and the connection P4. The first time period, for example, is experimentally calculated and stored in the microcomputer 32 in advance. The first time period may be 10 seconds, for example.

In step S1206, with the pump 44 deactivated, the valve 22 is opened and the valve 26 is closed as illustrated in FIG. 10(*c*).

In step S1208, the pump 44 of the capping device 40 is driven for a second time period. Specifically, after a lapse of the second time period from the start of driving of the pump 44, the pump 44 is deactivated.

Driving the pump 44 causes the ink in the downstream regions 16*b* and 18*b* to move to the ink head 20, and causes the ink in the tube 28 to move to the downstream region 18*b*. As illustrated in FIG. 10(*d*), the ink in the upstream region 16*a* is divided at the connection P3 into ink flowing into the tube 28 and ink flowing into the downstream region 16*b*. Then, the ink in the downstream regions 16*b* and 18*b* reaches the ink head 20. The ink in the tube 28 flows through the downstream region 18*b* and reaches the ink head 20. Thus, the ink is drained from the tubes 16, 18, and 28.

The second time period is set so as to drain ink from the tube 16, the tube 28, and the downstream region 18*b* of the tube 18. The second time period, for example, is experimentally calculated and stored in the microcomputer 32 in advance. The second time period is typically longer than the first time period, and may be 60 seconds, for example.

In this example, the microcomputer 32 functions as the first control section 321 in steps S1202 and S1204, and functions as the second control section 322 in steps S1206 and S1208. Steps S1202 and S1204 constitute an example of "step 1)" of an ink draining method. Steps S1206 and S1208 constitute an example of "step 2)" of the ink draining method.

The ink draining process thus disclosed makes it unlikely for ink to remain in the ink path 10 (e.g., the tube 28). Consequently, this ink draining process suitably removes ink from the ink path 10.

Second Exemplary Ink Draining Process

Figure 11:
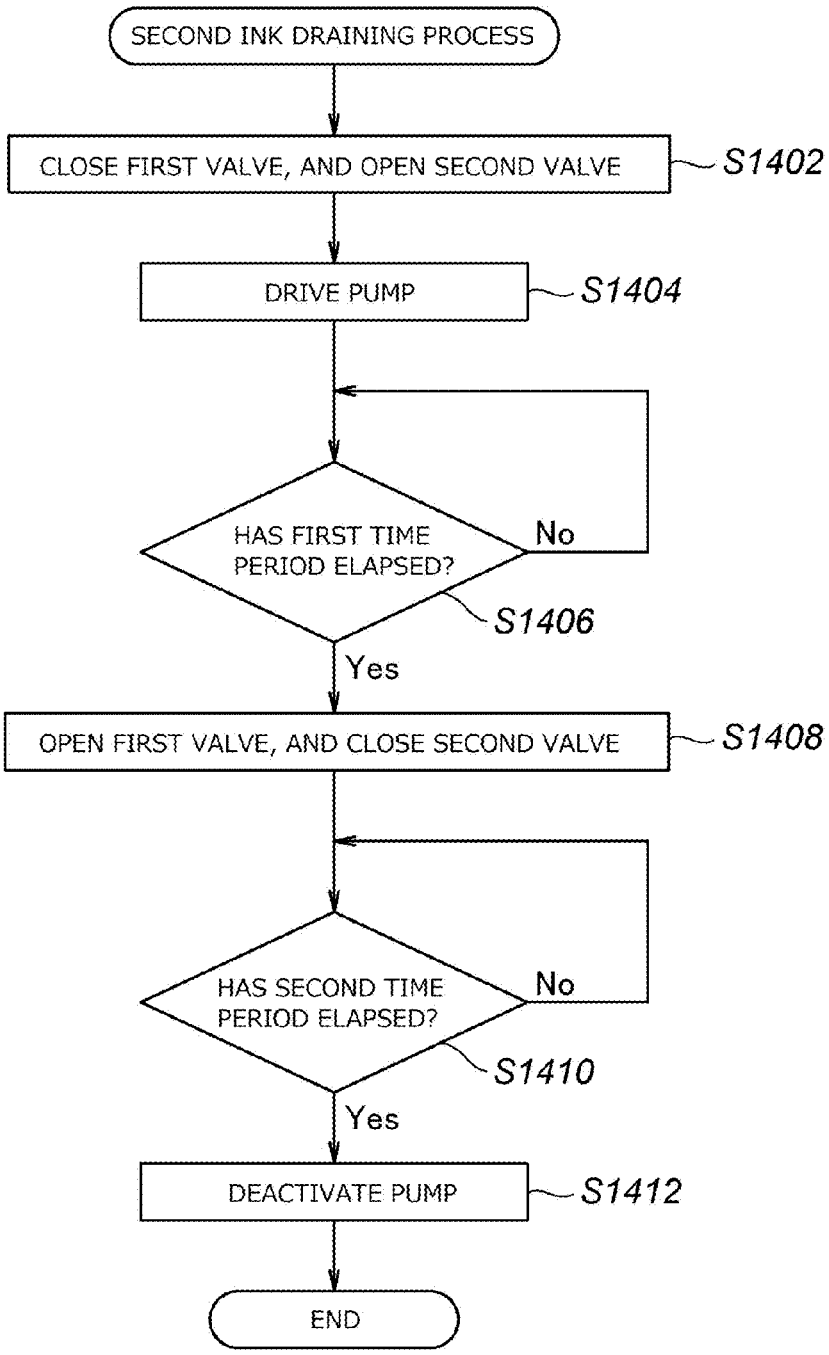
FIG. 11 is a flowchart illustrating the procedure of a second ink draining process.
Figure 12:
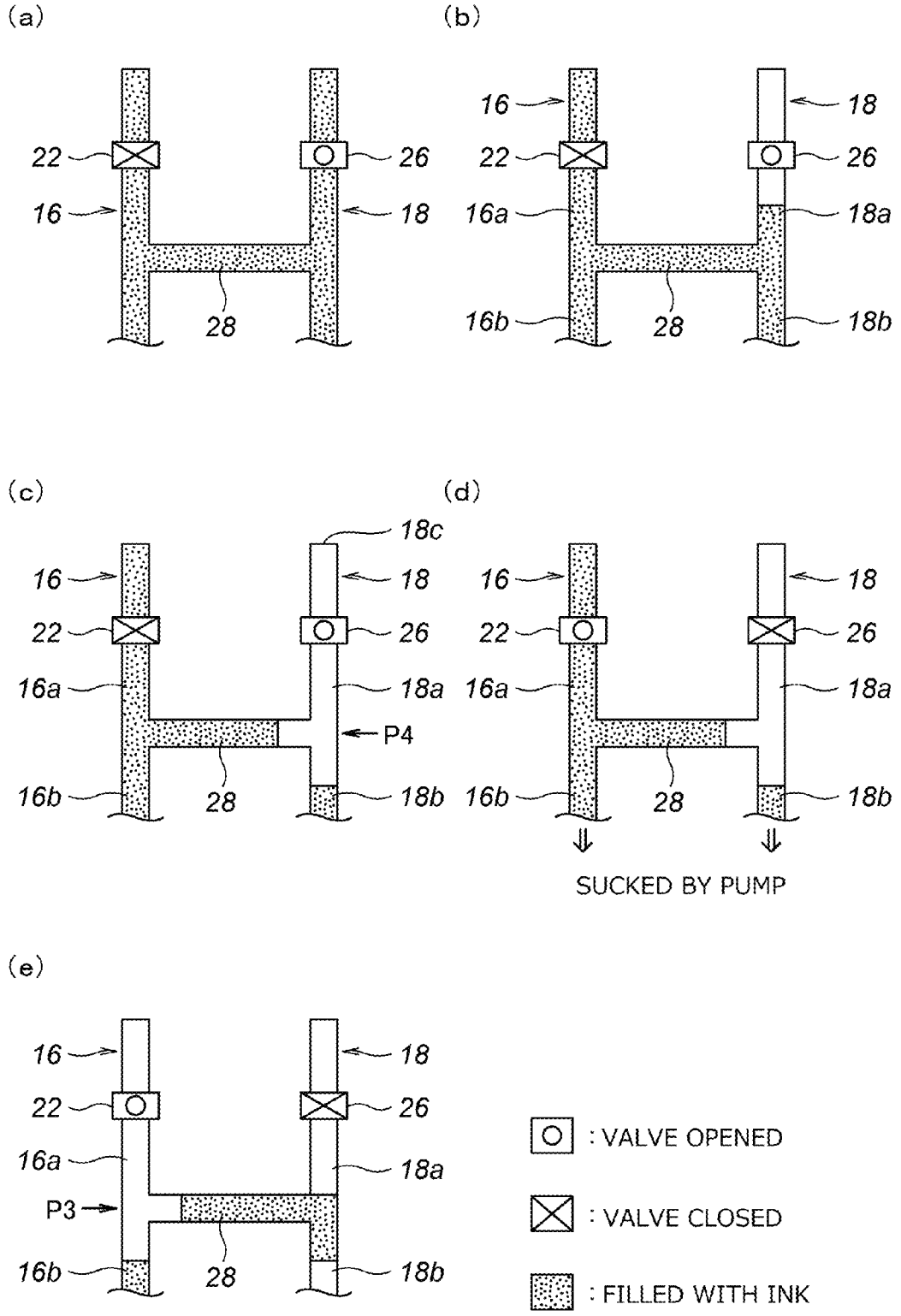
FIGS. 12(*a*) to 12(*e*) are schematic diagrams illustrating how ink is drained from the ink path in the second ink draining process.

FIG. 11 is a flowchart illustrating the procedure of a second exemplary ink draining process, i.e., a second ink draining process. FIGS. 12(*a*) to 12(*e*) are schematic diagrams illustrating how ink is drained from the ink path in the second ink draining process.

As illustrated in FIG. 12(*a*), at the start of the second ink draining process, the ink path 10 is filled with ink as in the first ink draining process. The ink cartridges 12 and 14 are respectively detached from the tubes 16 and 18.

In the second ink draining process, first, the valve 22 is closed and the valve 26 is opened in step S1402 as illustrated in FIG. 12(*a*).

In step S1404, the pump 44 of the capping device 40 is driven. Driving the pump 44 causes the ink in the upstream region 18*a* of the tube 18 to be drained therefrom as illustrated in FIG. 12(*b*).

In step S1406, the microcomputer 32 determines whether the first time period has elapsed. The first time period may be set in a manner similar to that used in the first exemplary ink draining process.

Following a determination that the first time period has not yet elapsed, step S1406 is repeated. Specifically, step S1406 is repeated until the determination in this step indicates that the first time period has elapsed.

As illustrated in FIG. 12(*c*), upon lapse of the first time period from the start of driving of the pump 44, the ink is drained from the upstream region 18*a* of the tube 18, a portion of the downstream region 18*b*, and a portion of the tube 28 similarly to the first ink draining process.

Following a determination in step S1406 that the first time period has elapsed, step S1408 is performed. Specifically, with the pump 44 kept in the driven state, the microcomputer 32 opens the valve 22 and closes the valve 26 as illustrated in FIG. 12(*d*).

After opening the valve 22 and closing the valve 26, the ink in the downstream regions 16*b* and 18*b* moves to the ink head 20, and the ink in the tube 28 moves to the downstream region 18*b*. The ink in the upstream region 16*a* is divided at the connection P3 into ink flowing into the tube 28 and ink flowing into the downstream region 16*b* as illustrated in FIG. 12(*e*).

In step S1410, the microcomputer 32 determines whether a second time period has elapsed. The second time period may be set in a manner similar to that used in the first exemplary ink draining process.

Following a determination that the second time period has not yet elapsed, step S1410 is repeated. Specifically, step S1410 is repeated until the determination in this step indicates that the second time period has elapsed.

Following a determination that the second time period has elapsed, step S1412 is performed. Specifically, assuming that the ink has been drained from the ink path 10, the pump 44 is deactivated. Thus, the ink draining process ends.

In the course of the second time period after the valve 22 has been opened and the valve 26 has been closed, the ink in the ink path 10 is sucked. This causes the ink in the downstream regions 16*b* and 18*b* to move to the ink head 20, and causes the ink in the tube 28 to move to the ink head 20 through the downstream region 18*b*. Consequently, the ink is drained from the tubes 16, 18, and 28.

In the second ink draining process, suction is already applied by the pump 44 when the valve 22 is switched from the closed state to the opened state in step S1408. In other words, the suction device is activated in advance before the valves are opened or closed to allow switching to the second state. This prevents the ink from flowing out (or spout) from the upstream end of the tube 16.

(3) Method for Cleaning Ink Path

The worker operates an operating element (not illustrated) of the inkjet printer 200 so as to provide an instruction for cleaning the ink path 10. In response to this instruction, the lower surface 20*a* of the ink head 20 is capped with the capping device 40 (FIG. 2) so as to start a cleaning process. Although the following description is directed to cleaning of the ink path 10 filled with ink, the ink path 10 not filled with ink may also be cleaned in a manner similar to that described below.

First Exemplary Cleaning Process

Figure 13:
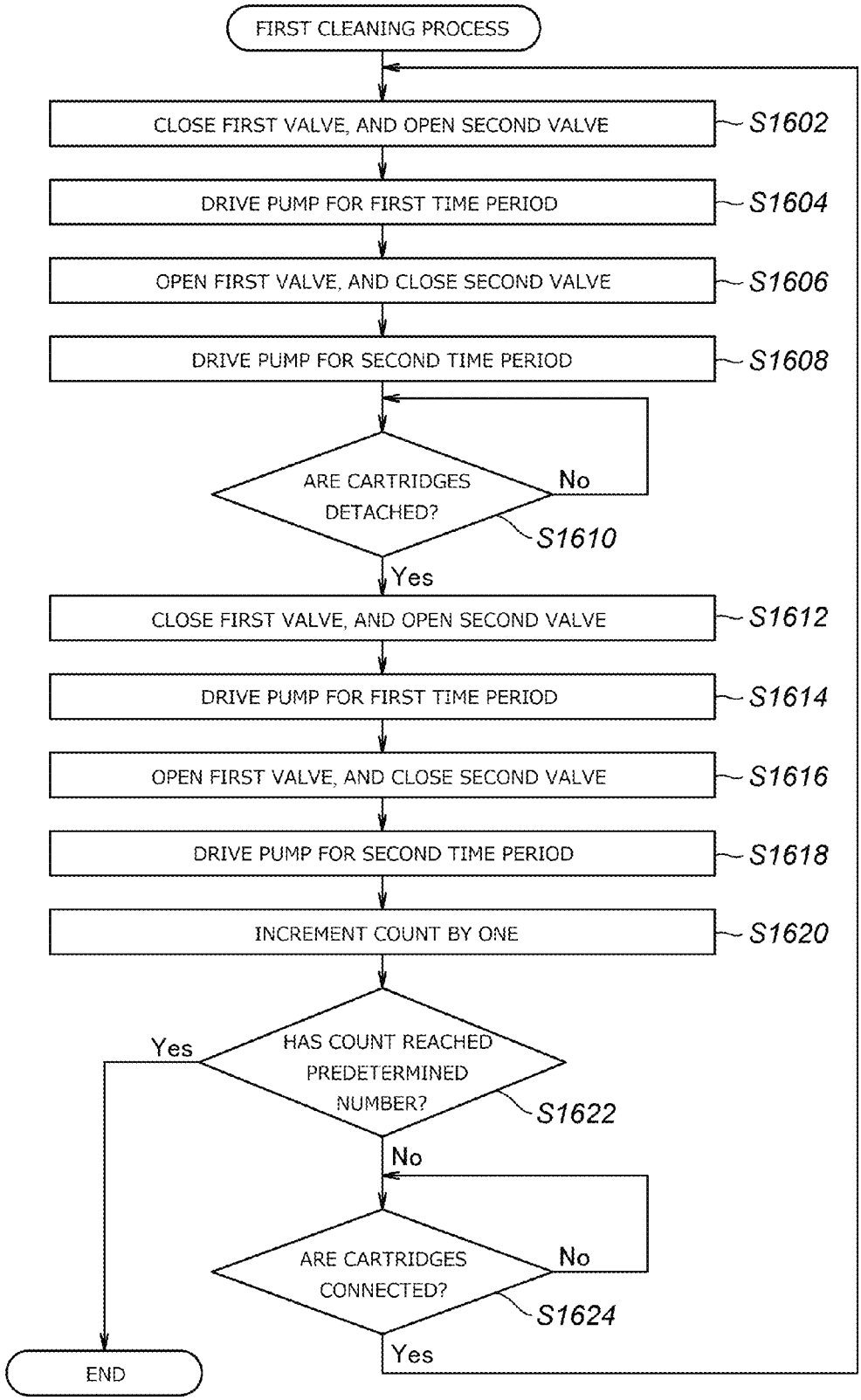
FIG. 13 is a flowchart illustrating the procedure of a first cleaning process.
Figure 14:
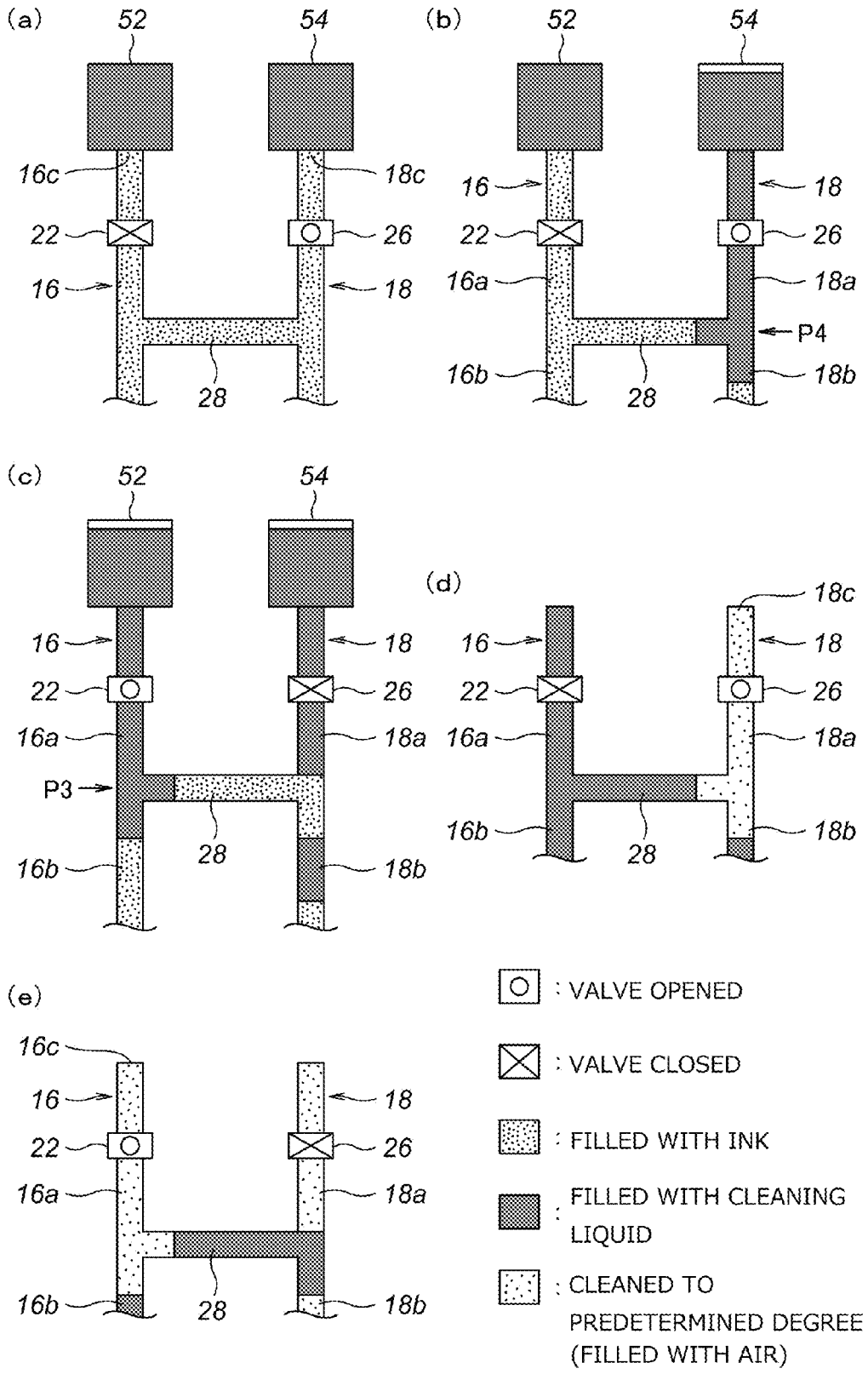
FIGS. 14(*a*) to 14(*e*) are schematic diagrams illustrating how the ink path is cleaned in the first cleaning process.

FIG. 13 is a flowchart illustrating the procedure of a first exemplary cleaning process, i.e., a first cleaning process. FIGS. 14(*a*) to 14(*e*) are schematic diagrams illustrating how the ink path is cleaned in the first cleaning process.

As illustrated in FIG. 14 (*a*), at the start of the first cleaning process, the end 16*c* of the tube 16 is connected to the cleaning liquid cartridge 52, and the end 18*c* of the tube 18 is connected to the cleaning liquid cartridge 54.

Broadly speaking, the first cleaning process includes the steps of: allowing cleaning liquid to flow into the ink path (i.e., steps S1602, S1604, S1606, and S1608); detaching the cleaning liquid cartridges (i.e., step S1610); allowing air to flow into the ink path (i.e., steps S612, S614, S616, and S618); counting the number of times cleaning has been performed (i.e., steps S620 and S1622); and connecting the ink cartridges (i.e., step S1624).

Of these steps, the step of allowing cleaning liquid to flow into the ink path may be performed using the first ink filling process described above. In that case, the expression "sucking ink" in the description of the first ink filling process may be read as "sucking cleaning liquid", the term "ink" in the description of the first ink filling process may be read as "cleaning liquid" or "ink and cleaning liquid" with reference to the associated figures, and FIGS. 4(*a*) and 4(*b*) in the description of the first ink filling process may be respectively read as FIGS. 14(*a*) and 14(*b*). The amount of cleaning liquid to be sucked from the cleaning liquid cartridge 52 in step S608 is set so as to fill the upstream region 16*a* of the tube 16, a portion of the downstream region 16*b*, and a portion of the tube 28 with the cleaning liquid as illustrated in FIG. 14(*c*). The amount of cleaning liquid to be sucked is adjustable by changing the second time period during which the pump 44 is to be driven. Accordingly, the second time period may be longer than, shorter than, or equal to the first time period.

In step S1610, the microcomputer 32 determines whether the cleaning liquid cartridge 52 is detached from the tube 16, and the cleaning liquid cartridge 54 is detached from the tube 18. This determination is made on the basis of a detection result obtained by a sensor (not illustrated) configured to detect a connection between the tube 16 and the cleaning liquid cartridge 52 and a detection result obtained by a sensor (not illustrated) configured to detect a connection between the tube 18 and the cleaning liquid cartridge 54.

Following a determination that at least one of the cleaning liquid cartridges 52 and 54 is not detached, step S1610 is repeated. Specifically, step S1610 is repeated until the determination in this step indicates that the cleaning liquid cartridges 52 and 54 are respectively detached from the tubes 16 and 18. When the determination in this step indicates that at least one of the cleaning liquid cartridges 52 and 54 is not detached, the display 224 of the inkjet printer 200 may present, for example, a prompt urging the worker to detach the cleaning liquid cartridge 52 and/or the cleaning liquid cartridge 54.

Following a determination that the cleaning liquid cartridges 52 and 54 are detached, step S1612 is performed. Specifically, the valve 22 is closed, and the valve 26 is opened.

The step of allowing air to flow into the ink path may be performed using the first ink draining process described above. Specifically, the term "ink" in the description of the first ink draining process may be read as "cleaning liquid" or "ink and cleaning liquid", the "ink cartridges 12 and 14" in the description of the first ink draining process may be read as the "cleaning liquid cartridges 52 and 54", and FIGS. 10(*b*) and 10(*d*) in the description of the first ink draining process may be respectively read as FIGS. 14(*d*) and 14(*e*). As illustrated in FIG. 14(*e*), the amount of air to be introduced in step S1618 is set so as to fill the upstream region 16*a* of the tube 16, a portion of the downstream region 16*b*, and a portion of the tube 28 with air. The amount of air to be introduced is adjustable by changing the second time period during which the pump 44 is to be driven.

In step S1614, the pump 44 is driven for the first time period so as to introduce a predetermined amount of air through the end 18*c* of the tube 18. This causes the cleaning liquid to be discharged from the upstream region 18*a*, a portion of the downstream region 18*b*, and a portion of the tube 28. Thus, the upstream region 18*a*, the portion of the downstream region 18*b*, and the portion of the tube 28 are cleaned.

In step S1618, the pump 44 is driven for the second time period so as to introduce a predetermined amount of air through the end 16*c* of the tube 16. This causes the cleaning liquid to be discharged from the upstream region 16*a*, a portion of the tube 28, and a portion of the downstream region 16*b*. Thus, the upstream region 16*a*, the portion of the tube 28, and the portion of the downstream region 16*b* are cleaned.

In step S1620, the microcomputer 32 increments the count by one. As used herein, the term "count" refers to the number of times a series of steps S1602 to S1618 has been performed.

In step S1622, the microcomputer 32 determines whether the count obtained in step S1620 has reached a predetermined number of times. As used herein, the term "predetermined number of times" refers to the number of times cleaning is performed to clean the ink path 10 sufficiently. The predetermined number of times, for example, is experimentally calculated and stored in the microcomputer 32 in advance. The predetermined number of times may be twice, for example.

Following a determination in step S1622 that the count has not yet reached the predetermined number of times, step S1624 is performed. Specifically, it is determined whether the cleaning liquid cartridges 52 and 54 are respectively connected to the tubes 16 and 18.

In step S1624, the microcomputer 32 determines whether the cleaning liquid cartridges 52 and 54 are respectively connected to the tubes 16 and 18. This determination is made on the basis of a detection result obtained by the sensor (not illustrated) configured to detect the connection between the tube 16 and the cleaning liquid cartridge 52 and a detection result obtained by the sensor (not illustrated) configured to detect the connection between the tube 18 and the cleaning liquid cartridge 54.

Following a determination that at least one of the cleaning liquid cartridges 52 and 54 is not connected, step S1624 is repeated. Specifically, step S1624 is repeated until the determination in this step indicates that the cleaning liquid cartridges 52 and 54 are respectively connected to the tubes 16 and 18. When the determination in this step indicates that at least one of the cleaning liquid cartridges 52 and 54 is not connected, the display 224 of the inkjet printer 200 may present, for example, a prompt urging the worker to connect the cleaning liquid cartridge 52 and/or the cleaning liquid cartridge 54.

Following a determination that the cleaning liquid cartridges 52 and 54 are respectively connected to the tubes 16 and 18, the process returns to step S1602 so as to repeat the series of steps described above.

Following a determination in step S1622 that the count has reached the predetermined number of times, the cleaning process ends. Upon end of the cleaning process, the count is reset to "0". In other words, the count is initialized. After the ink path 10 has been cleaned, the cleaning liquid may be drained from the ink path 10 in a manner similar to that described for the foregoing ink draining process.

In this example, the microcomputer 32 functions as the first control section 321 in steps S1602 and S1604, functions as the second control section 322 in steps S1606 and S1608, functions as the third control section 323 in steps S1612 and S1614, and functions as the fourth control section 324 in steps S1616 and S1618. The microcomputer 32 functions as the counting section 325 in step S1620. The microcomputer 32 functions as the determination section 326 in step S1622. Steps S1602 and S1604 constitute an example of "step 1)" of an ink path cleaning method. Steps S1606 and S1608 constitute an example of "step 2)" of the ink path cleaning method. Steps S1612 and S1614 constitute an example of "step 3)" of the ink path cleaning method. Steps S1616 and S1618 constitute an example of "step 4)" of the ink path cleaning method.

In this example, the pump driving time in step S1604 and the pump driving time in step S1614 are equal to each other, and are each equivalent to the first time period. Alternatively, the pump driving time in step S1604 and the pump driving time in step S1614 may be different from each other. Assuming that the pump driving time in step S1614 is a "third time period", the third time period may be equal to, shorter than, or longer than the first time period.

In this example, the pump driving time in step S1608 and the pump driving time in step S1618 are equal to each other, and are each equivalent to the second time period. Alternatively, the pump driving time in step S1608 and the pump driving time in step S1618 may be different from each other. Assuming that the pump driving time in step S1618 is a "fourth time period", the fourth time period may be equal to, shorter than, or longer than the second time period.

The ink path cleaning process thus disclosed allows cleaning liquid and air to flow into the ink path alternately, thus enabling the cleaning liquid to favorably flow through the ink path 10. Repeating the above-mentioned steps a predetermined number of times enables suitable cleaning of the ink path 10. The cleaning process also enables suitable removal of ink and cleaning liquid from the ink path, which has been cleaned.

Second Exemplary Cleaning Process

Figure 15:
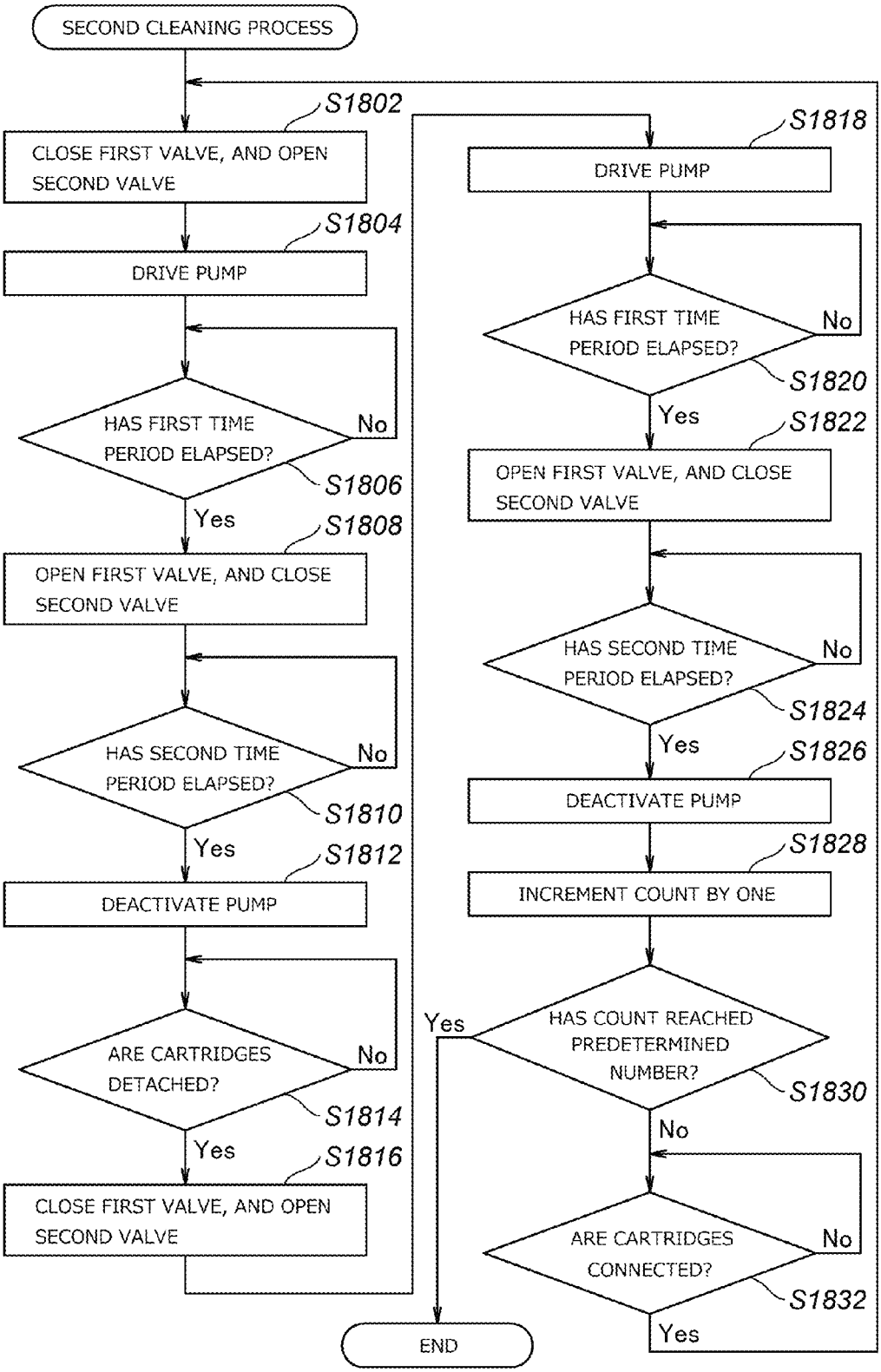
FIG. 15 is a flowchart illustrating the procedure of a second cleaning process.
Figure 16:
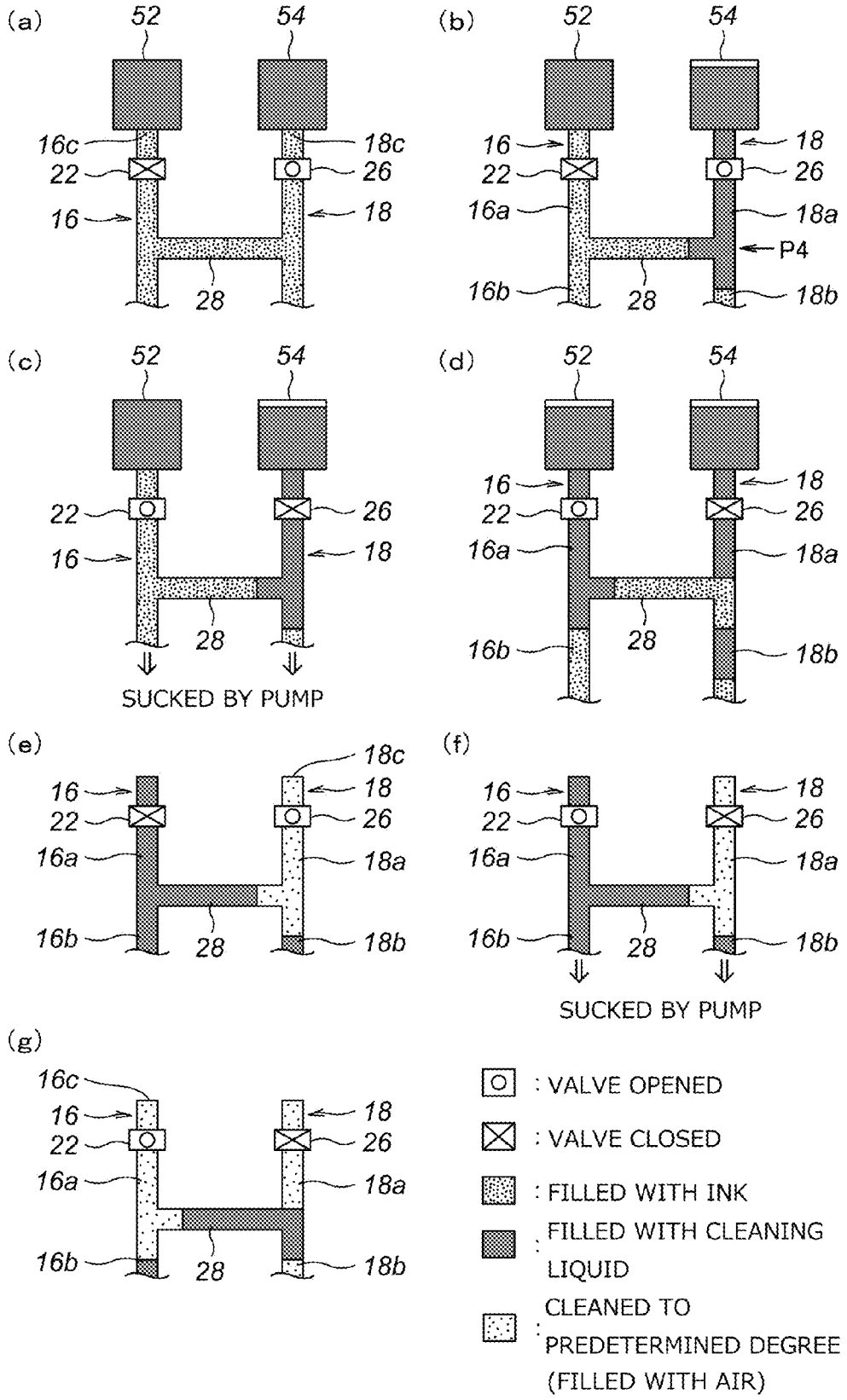
FIGS. 16(*a*) to 16(*g*) are schematic diagrams illustrating how the ink path is cleaned in the second cleaning process.

FIG. 15 is a flowchart illustrating the procedure of a second exemplary cleaning process, i.e., a second cleaning process. FIGS. 16(*a*) to 16(*g*) are schematic diagrams illustrating how the ink path is cleaned in the second cleaning process.

The second cleaning process is similar to the first cleaning process except that the step of allowing cleaning liquid to flow into the ink path is performed using the third ink filling process described above, and that the step of allowing air to flow into the ink path is performed using the second ink draining process described above. FIGS. 14(*a*), 14(*b*), 14(*c*), 14(*d*), and 14(*e*) for the first cleaning process may be respectively read as FIGS. 16(*a*), 16(*b*), 16(*d*), 16(*e*), and 16(*g*). FIG. 16(*c*) illustrates a state similar to that in FIG. 8(*c*) for the third ink filling process. FIG. 16(*f*) illustrates a state similar to that in FIG. 12(*d*) for the second ink draining process.

In the second cleaning process, suction is already applied by the pump 44 when the valve 22 is switched from the closed state to the opened state in steps S1808 and S1822. In other words, the suction device is activated in advance before the valves are opened or closed to enable switching to the second state. This keeps ink from flowing out (or spout) from the upstream end of the tube 16, and prevents ink or cleaning liquid from flowing into the cleaning liquid cartridge 52.

Although the embodiment and examples of the present invention have been described thus far, the present invention is not limited to these embodiment and examples but may be practiced in various other embodiments.

Figure 17:
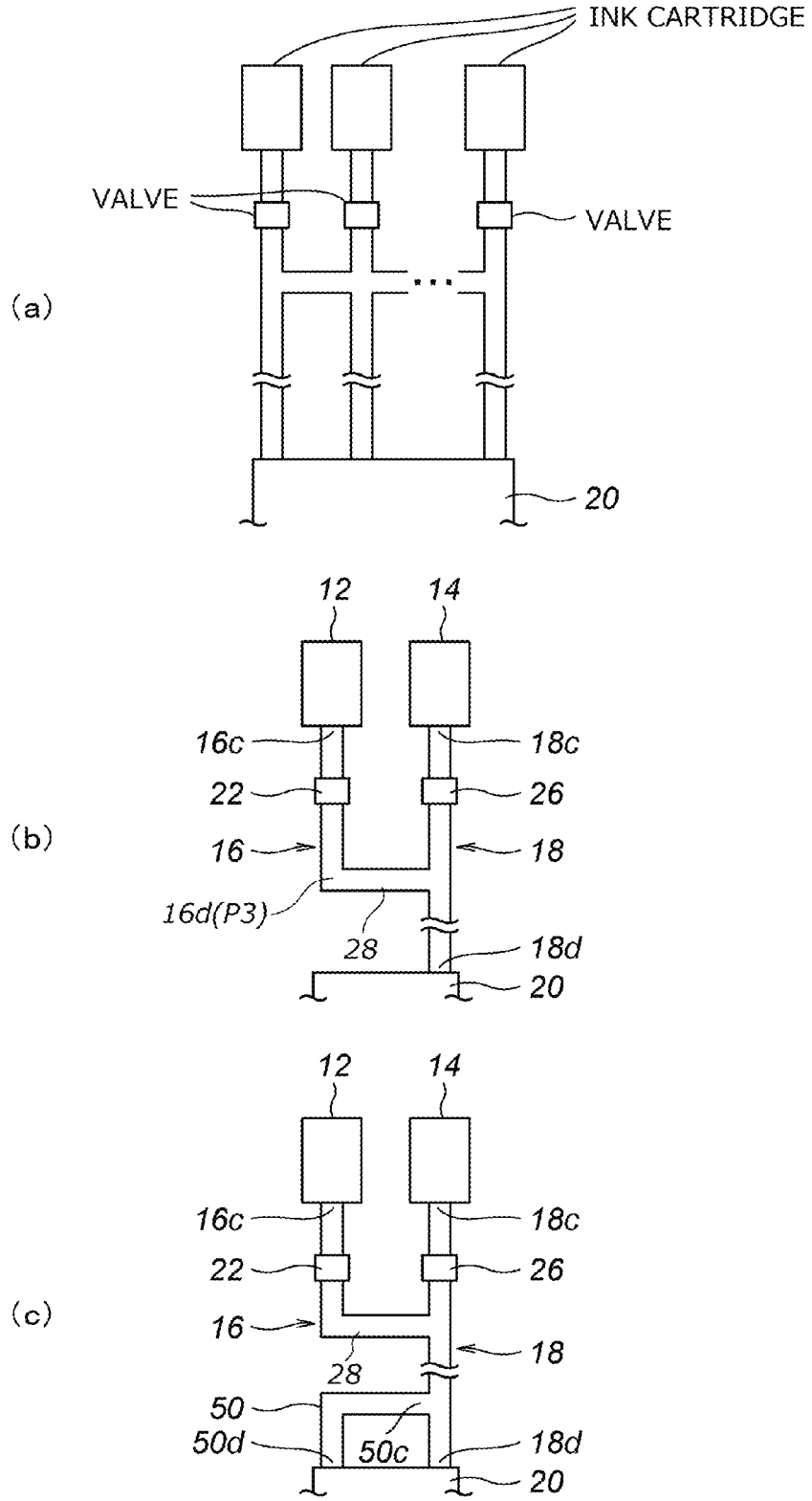
FIGS. 17(*a*) to 17(*c*) are schematic diagrams illustrating variations of the ink path.
Figure 18:
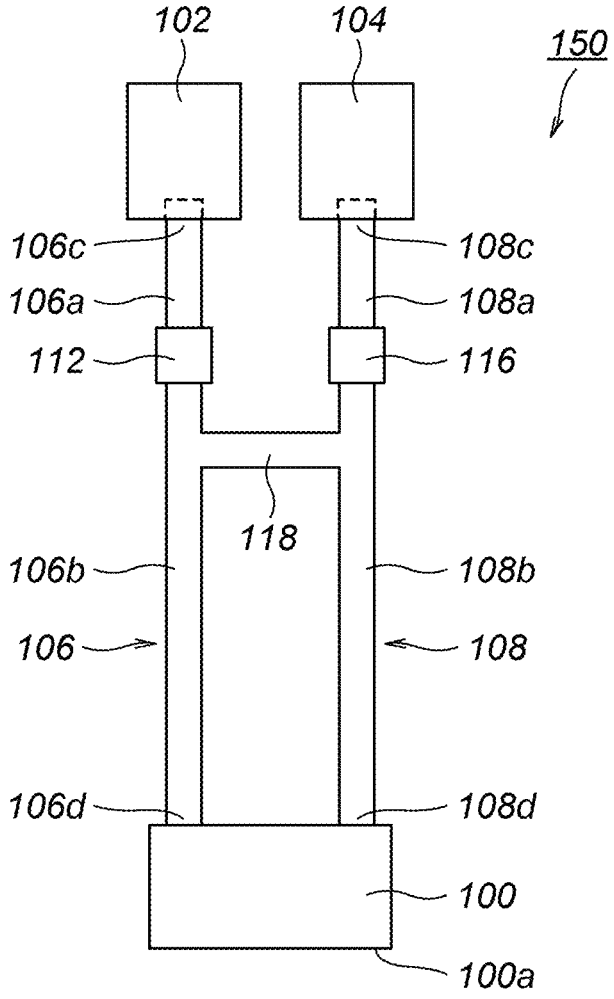
FIG. 18 is a schematic diagram of an ink path known in the art.
Figure 19:
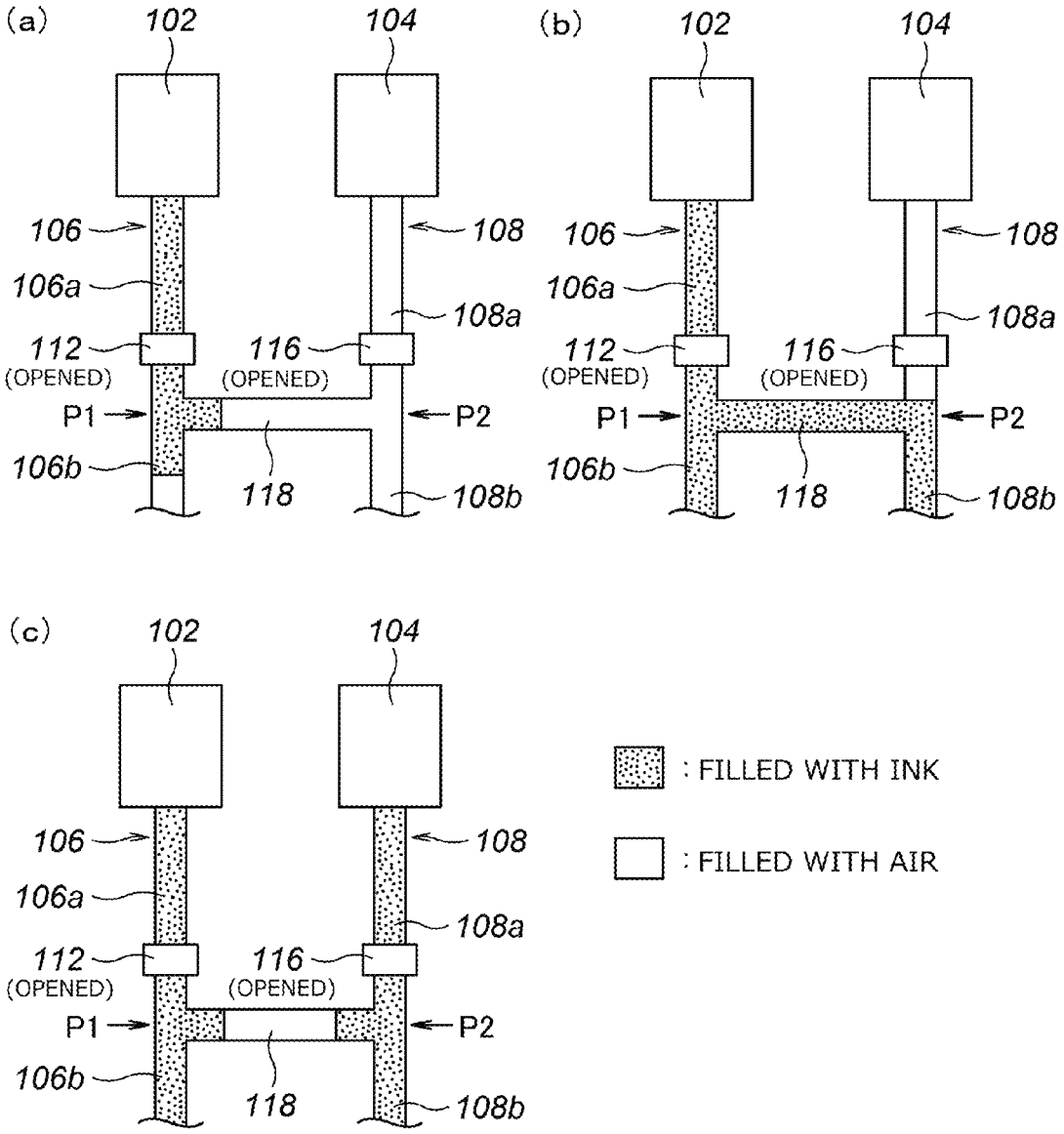
FIGS. 19(*a*) to 19(*c*) are schematic diagrams illustrating how the ink path illustrated in FIG. 18 is filled with ink.
Figure 20:
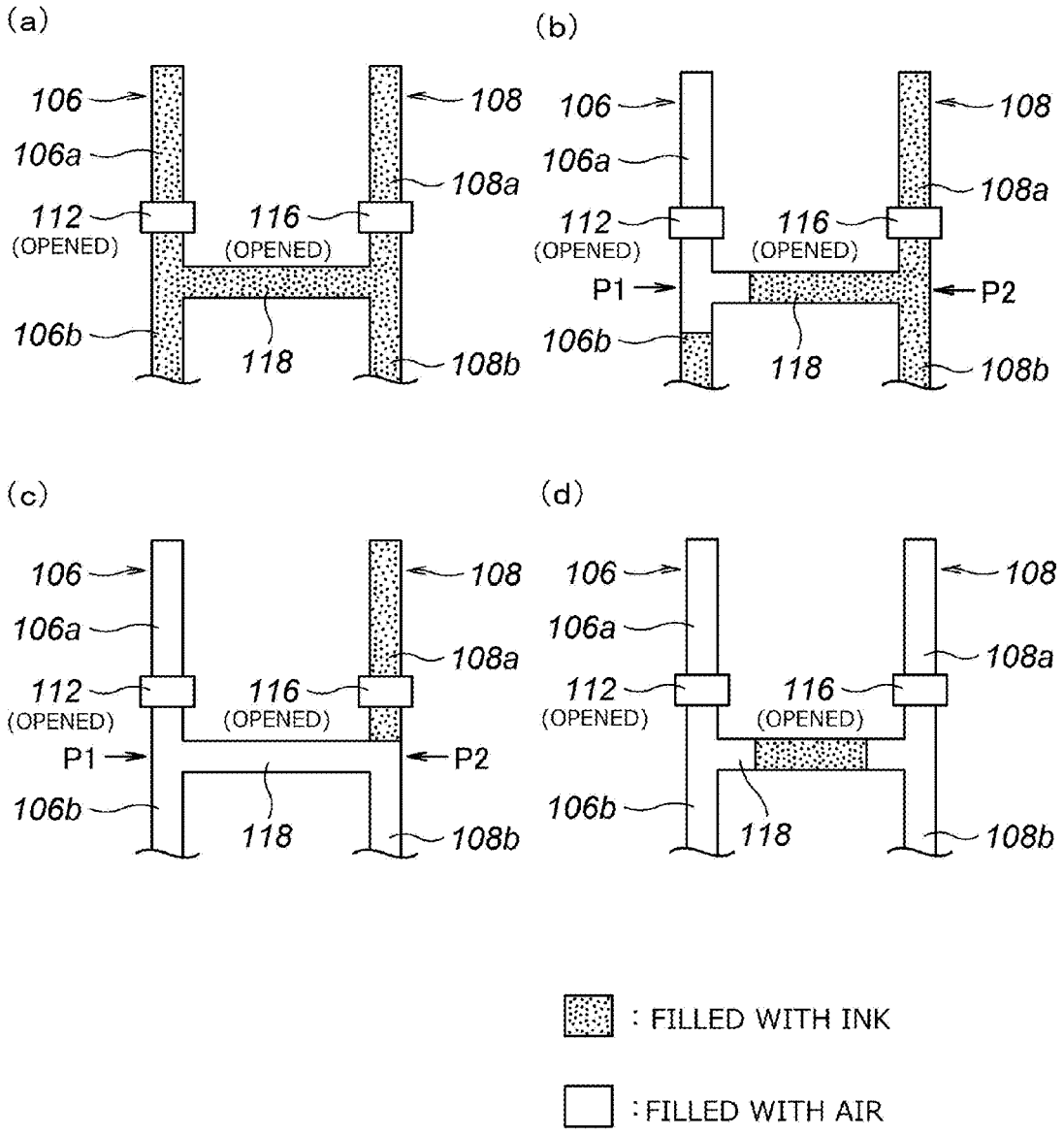
FIGS. 20(*a*) to 20(*d*) are schematic diagrams illustrating how ink is drained from the ink path illustrated in FIG. 18.
Figure 21:
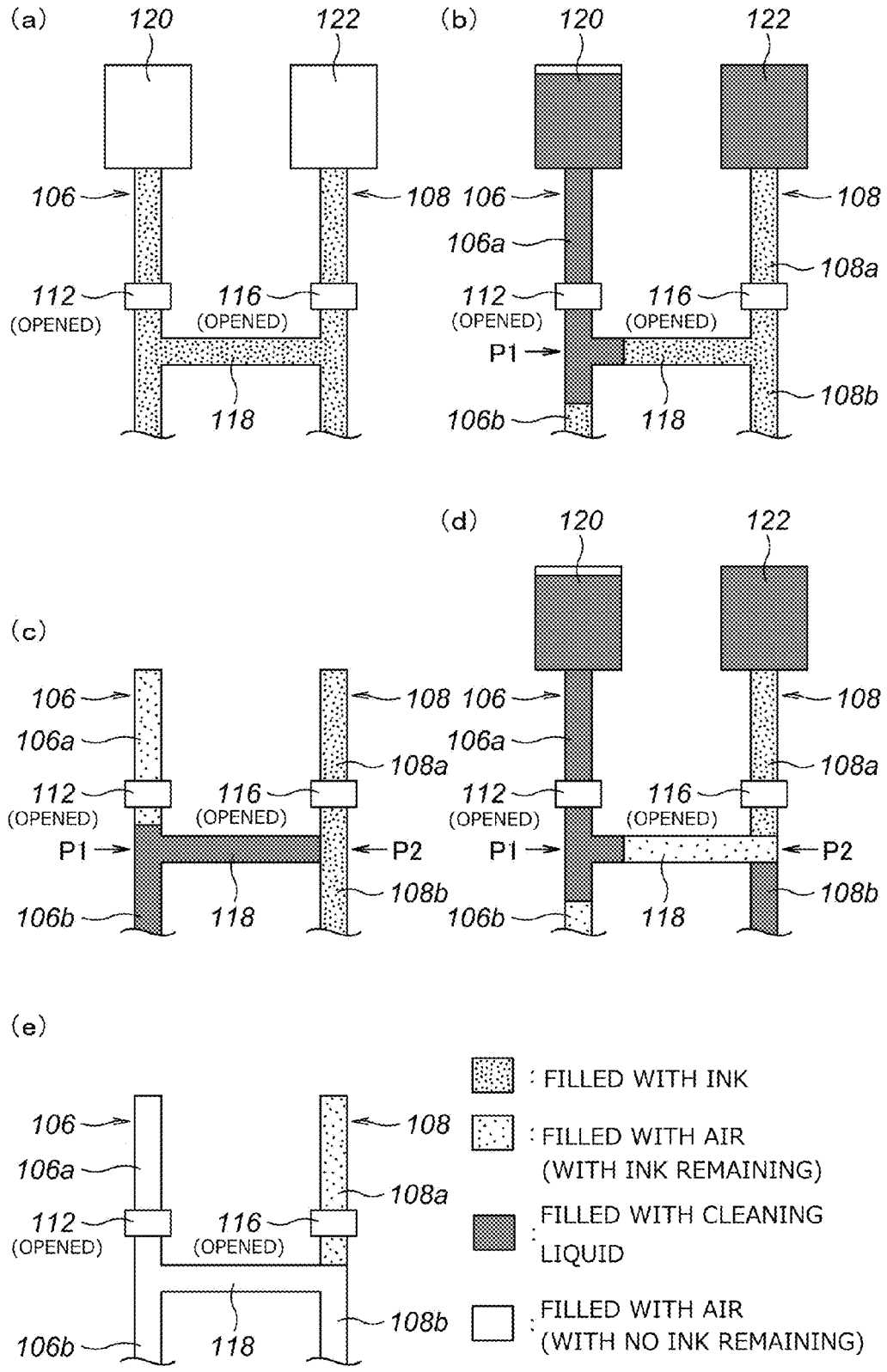
FIGS. 21(*a*) to 21(*e*) are schematic diagrams illustrating how the ink path illustrated in FIG. 18 is cleaned.

Although two tubes are connected to each other through a single tube so as to provide an ink path in the foregoing embodiment and examples, the present invention is naturally not limited to this arrangement. For example, as illustrated in FIG. 17(*a*), the inkjet printer may include three or more tubes so that adjacent ones of the tubes are connected to each other to provide an ink path. In such an example, the number of ink cartridges and the number of valves are each equal to the number of tubes, which is three or more.

In this example, the controller 320 is configured to enable switching between: a first state in which suction is applied by the suction device through the ink head for a first time period, with predetermined one(s) of the plurality of valves (e.g., a single one of the plurality of valves) closed and the other valve(s) opened; and a second state in which suction is applied by the suction device through the ink head for a second time period, with the predetermined one(s) of the plurality of valves opened and the other valve(s) closed.

In the foregoing embodiment and examples, the tube 16 and the tube 18 are connected to each other through the tube 28. One end 16*c* of the tube 16 is connected to the ink cartridge 12, and the other end 16*d* of the tube 16 is connected to the ink head 20. One end 18*c* of the tube 18 is connected to the ink cartridge 14, and the other end 18*d* of the tube 18 is connected to the ink head 20. The ink path, however, is not limited to this arrangement.

For example, as illustrated in FIG. 17(*b*), the end 16*d* of the tube 16 may be connected to the tube 28. In such an example, the end 16*d* also serves as the connection P3. The end 16*d* of the tube 16 is in communication with the ink head 20 through the tube 28 and a portion of the tube 18.

For example, as illustrated in FIG. 17(*c*), the inkjet printer may further include a tube 50 including: one end 50*c* connected to the tube 18 at a location closer to the ink head 20 than the connection between the tube 16 and the tube 18; and the other end 50*d* connected to the ink head 20.

In the foregoing embodiment and examples, one of the valves 22 and 26 is opened and the other one of the valves 22 and 26 is closed when the cleaning liquid cartridges 52 and 54 are respectively connected to or detached from the tubes 16 and 18. Alternatively, both of the valves 22 and 26, for example, may naturally be closed in such a case.

In the foregoing embodiment and examples, the first time period and the second time period are stored in advance in the microcomputer 32. Alternatively, the first time period and/or the second time period may be input by a user, and/or changed by the user where appropriate. In the foregoing embodiment and examples, the predetermined number of times in step S1622 is stored in advance in the microcomputer 32. Alternatively, the predetermined number of times may be input by the user, and/or changed by the user where appropriate.

The foregoing embodiment and examples may be combined with other embodiments and examples as deemed appropriate.

REFERENCE SIGNS LIST

10 ink path
12, 14 ink cartridge
16, 18, 28 tube
20 ink head
22, 26 valve
32 microcomputer (controller)
44 pump (suction device)
52, 54 cleaning liquid cartridge

The invention claimed is:

1. An inkjet printer comprising:
an ink head to discharge ink;
a first ink path including
a first upstream end connectable with a first cartridge storing ink or cleaning liquid, and
a first downstream end in communication with the ink head;
a second ink path including
a second upstream end connectable with a second cartridge storing ink or cleaning liquid, and
a second downstream end in communication with the ink head;
a third ink path including
a first connection connected to the first ink path, and
a second connection connected to the second ink path;
a first valve disposed in a portion of the first ink path between the first upstream end and the first connection;
a second valve disposed in a portion of the second ink path between the second upstream end and the second connection;
a suction device attached to the ink head, the suction device being configured to apply suction to a fluid in the first ink path, the second ink path, and the third ink path through the ink head; and
a controller to exercise control to open and close the first valve and the second valve, and activate and deactivate the suction device, the controller including
a first control section to perform a first operation in which the suction device is driven for a first time period, with the first valve closed and the second valve opened, and
a second control section to perform, after the first operation, a second operation in which the suction device is driven for a second time period, with the first valve opened and the second valve closed.

2. The inkjet printer according to claim 1, wherein
the first downstream end of the first ink path is connected to the ink head,
the second downstream end of the second ink path is connected to the ink head,
the first connection is disposed between the first upstream end and the first downstream end of the first ink path, and
the second connection is disposed between the second upstream end and the second downstream end of the second ink path.

3. The inkjet printer according to claim 1, wherein
the second control section is configured to open the first valve and close the second valve, with the suction device driven.

4. The inkjet printer according to claim 1, wherein
the first cartridge is a first ink cartridge storing ink,
the second cartridge is a second ink cartridge storing ink,
the first control section is configured to perform the first operation when the second upstream end of the second ink path is connected with the second ink cartridge, and
the second control section is configured to perform the second operation when the first upstream end of the first ink path is connected with the first ink cartridge and the second upstream end of the second ink path is connected with the second ink cartridge.

5. The inkjet printer according to claim 4, wherein
the first control section is configured to perform the first operation when the first upstream end of the first ink path is not connected with the first ink cartridge and the second upstream end of the second ink path is connected with the second ink cartridge.

6. The inkjet printer according to claim 4, wherein
the first control section is configured to perform the first operation until at least a portion of the second ink path between the second upstream end and the second connection is filled with the ink, and the second control section is configured to perform the second operation until the first ink path, the second ink path, and the third ink path are filled with the ink.

7. The inkjet printer according to claim 4, further comprising an ink remaining amount calculator to calculate the amount of ink remaining in the first ink cartridge and the amount of ink remaining in the second ink cartridge on a basis of the first time period and the second time period.

8. The inkjet printer according to claim 1, wherein the first control section is configured to perform the first operation when the second upstream end of the second ink path is not connected with the second cartridge, and the second control section is configured to perform the second operation when the first upstream end of the first ink path is not connected with the first cartridge.

9. The inkjet printer according to claim 1, wherein the first cartridge is a first cleaning liquid cartridge storing cleaning liquid, the second cartridge is a second cleaning liquid cartridge storing cleaning liquid, the first control section is configured to perform the first operation when the second upstream end of the second ink path is connected with the second cleaning liquid cartridge, the second control section is configured to perform the second operation when the first upstream end of the first ink path is connected with the first cleaning liquid cartridge, and the inkjet printer further comprises:

a third control section to perform, after the second operation, a third operation in which the suction device is driven for a third time period, with the first valve closed and the second valve opened, the third operation being performed when the second upstream end of the second ink path is not connected with the second cleaning liquid cartridge; and a fourth control section to perform, after the third operation, a fourth operation in which the suction device is driven for a fourth time period, with the first valve opened and the second valve closed, the fourth operation being performed when the first upstream end of the first ink path is not connected with the first cleaning liquid cartridge.

10. The inkjet printer according to claim 9, wherein the controller further includes:

a counting section to count the number of times the first to fourth operations have been performed; and a determination section to determine whether the number of times counted by the counting section has reached a predetermined number of times, and the first control section is configured to perform, after the fourth operation, no first operation following a determination by the determination section that the predetermined number of times has been reached, and to perform, after the fourth operation, the first operation following a determination by the determination section that the predetermined number of times has not been reached.

* * * * *